US010060190B2

(12) United States Patent
Odell, II et al.

(10) Patent No.: US 10,060,190 B2
(45) **Date of Patent: *Aug. 28, 2018**

(54) EXTENDABLE CUTTING TOOLS FOR USE IN A WELLBORE

(71) Applicant: Weatherford Technology Holdings, LLC, Houston, TX (US)

(72) Inventors: Albert C. Odell, II, Kingwood, TX (US); Frederick T. Tilton, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 938 days.

This patent is subject to a terminal disclaimer.

(21) Appl. No.: 14/450,661

(22) Filed: Aug. 4, 2014

(65) Prior Publication Data

US 2014/0338976 A1 Nov. 20, 2014

Related U.S. Application Data

(60) Division of application No. 13/748,193, filed on Jan. 23, 2013, now Pat. No. 8,794,354, which is a division (Continued)

(51) Int. Cl.
*E21B 10/32* (2006.01)
*E21B 23/04* (2006.01)

(Continued)

(52) U.S. Cl.
CPC ..... *E21B 10/322* (2013.01); *E21B 7/28* (2013.01); *E21B 10/32* (2013.01); *E21B 23/04* (2013.01);

(Continued)

(58) Field of Classification Search
CPC ..... E21B 7/28; E21B 10/32; E21B 10/322; E21B 10/325; E21B 10/327; E21B 10/34; E21B 10/345
See application file for complete search history.

(56) References Cited

U.S. PATENT DOCUMENTS 2,170,451 A 8/1939 Grant
3,092,188 A 6/1963 Farris et al.

(Continued)

FOREIGN PATENT DOCUMENTS

CA 2298298 A1 8/2000
WO 2003102354 A1 12/2003

(Continued)

OTHER PUBLICATIONS

Australian Examination Report dated Mar. 16, 2016, for Australian Patent Application No. 2013203056.

(Continued)

*Primary Examiner* — Blake E Michener
(74) *Attorney, Agent, or Firm* — Patterson & Sheridan, L.L.P.

(57) ABSTRACT

Embodiments of the present invention generally relate to extendable cutting tools for use in a wellbore. In one embodiment, a tool for use in a wellbore includes a tubular body having a bore therethrough, an opening through a wall thereof, and a connector at each longitudinal end thereof; and an arm. The arm is pivotally connected to a first piston and rotationally coupled to the body, is disposed in the opening in a retracted position, and is movable to an extended position where an outer surface of the arm extends outward past an outer surface of the body. The tool further includes the first piston. The first piston is disposed in the body bore, has a bore therethrough, and is operable to move the arm from the retracted position to the extended position in response to fluid pressure in the piston bore exceeding fluid pressure in the opening. The tool further includes a lock operable to retain the first piston in the retracted position; and a second piston operably coupled to the lock.

20 Claims, 23 Drawing Sheets

Related U.S. Application Data of application No. 12/616,107, filed on Nov. 10, 2009, now Pat. No. 8,540,035, which is a continuation-in-part of application No. 12/436,077, filed on May 5, 2009, now Pat. No. 8,991,489.

(60) Provisional application No. 61/113,198, filed on Nov. 10, 2008, provisional application No. 61/050,511, filed on May 5, 2008.

(51) Int. Cl.

| | |
|---|---|
| ***E21B 7/28*** | (2006.01) |
| ***E21B 47/00*** | (2012.01) |
| ***E21B 47/12*** | (2012.01) |
| ***E21B 47/14*** | (2006.01) |

(52) U.S. Cl.

CPC ..... *E21B 47/00* (2013.01); *E21B 47/12* (2013.01); *E21B 47/122* (2013.01); *E21B 47/14* (2013.01)

(56) References Cited

U.S. PATENT DOCUMENTS

| | | | |
|---|---|---|---|
| 3,233,674 | A | 2/1966 | Leutwyler |
| 3,669,190 | A | 6/1972 | Sizer et al. |
| 3,813,656 | A | 5/1974 | Fowler |
| 3,820,389 | A | 6/1974 | Richter, Jr. et al. |
| 4,013,945 | A | 3/1977 | Grosso |
| RE29,471 | E | 11/1977 | Giroux |
| 4,224,986 | A | 9/1980 | Rothberg |
| 4,224,993 | A | 9/1980 | Huckaby |
| 4,273,372 | A | 6/1981 | Sheshtawy |
| 4,282,941 | A | 8/1981 | Perkin |
| 4,515,225 | A | 5/1985 | Dailey |
| 4,763,258 | A | 8/1988 | Engelder |
| 5,203,414 | A | 4/1993 | Hromas et al. |
| 5,332,048 | A | 7/1994 | Underwood et al. |
| 5,558,153 | A | 9/1996 | Holcombe et al. |
| 5,615,741 | A | 4/1997 | Coronado |
| 5,695,009 | A | 12/1997 | Hipp |
| 5,706,896 | A | 1/1998 | Tubel et al. |
| 5,785,120 | A | 7/1998 | Smalley et al. |
| 6,021,095 | A | 2/2000 | Tubel et al. |
| 6,055,213 | A | 4/2000 | Rubbo et al. |
| 6,267,185 | B1 | 7/2001 | Mougel et al. |
| 6,289,999 | B1 | 9/2001 | Dewey et al. |
| 6,321,847 | B1 | 11/2001 | Brown |
| 6,343,649 | B1 | 2/2002 | Beck et al. |
| 6,349,767 | B2 | 2/2002 | Gissler |
| 6,349,772 | B2 | 2/2002 | Mullen et al. |
| 6,408,945 | B1 | 6/2002 | Telfer |
| 6,443,228 | B1 | 9/2002 | Aronstam et al. |
| 6,536,524 | B1 | 3/2003 | Snider |
| 6,608,565 | B1 | 8/2003 | Van Steenwyk et al. |
| 6,668,949 | B1 | 12/2003 | Rives |
| 6,712,146 | B2 | 3/2004 | Estep et al. |
| 6,736,210 | B2 | 5/2004 | Hosie et al. |
| 6,776,240 | B2 | 8/2004 | Kenison et al. |
| 6,802,373 | B2 | 10/2004 | Dillenbeck et al. |
| 6,834,726 | B2 | 12/2004 | Giroux et al. |
| 6,845,820 | B1 | 1/2005 | Hebert et al. |
| 6,877,567 | B2 | 4/2005 | Hirth |
| 6,892,819 | B2 | 5/2005 | Cook et al. |
| 6,997,266 | B2 | 2/2006 | Jackson et al. |
| 7,011,162 | B2 | 3/2006 | Maguire |
| 7,044,229 | B2 | 5/2006 | Tennoy et al. |
| 7,048,078 | B2 | 5/2006 | Dewey et al. |
| 7,063,142 | B2 | 6/2006 | Cook et al. |
| 7,093,656 | B2 | 8/2006 | Maguire |
| 7,100,713 | B2 | 9/2006 | Tulloch |
| 7,114,573 | B2 | 10/2006 | Hirth et al. |
| 7,159,667 | B2 | 1/2007 | Cook et al. |
| 7,172,021 | B2 | 2/2007 | Brisco et al. |
| RE39,583 | E | 4/2007 | Upchurch |
| 7,225,870 | B2 | 6/2007 | Pedersen et al. |
| 7,225,880 | B2 | 6/2007 | Braddick |
| 7,243,731 | B2 | 7/2007 | Watson et al. |
| 7,245,229 | B2 | 7/2007 | Baron et al. |
| 7,252,152 | B2 | 8/2007 | LoGiudice et al. |
| 7,290,616 | B2 | 11/2007 | Cook et al. |
| 7,322,410 | B2 | 1/2008 | Vinegar et al. |
| 7,360,594 | B2 | 4/2008 | Giroux et al. |
| 7,363,691 | B2 | 4/2008 | Cook et al. |
| 7,370,712 | B2 | 5/2008 | Stout et al. |
| 7,401,666 | B2 | 7/2008 | Fanuel et al. |
| 7,438,133 | B2 | 10/2008 | Brisco |
| 7,556,092 | B2 | 7/2009 | Cook et al. |
| 7,562,712 | B2 | 7/2009 | Cho et al. |
| 7,588,100 | B2 | 9/2009 | Hamilton |
| 7,603,758 | B2 | 10/2009 | Cook et al. |
| 7,703,553 | B2 | 4/2010 | Eddison et al. |
| 7,762,330 | B2 | 7/2010 | Saylor, III et al. |
| 7,891,441 | B2 | 2/2011 | Lee |
| 7,900,717 | B2 | 3/2011 | Radford et al. |
| 8,006,779 | B2 | 8/2011 | Moore et al. |
| 8,028,763 | B2 | 10/2011 | Mackenzie |
| 8,028,767 | B2 | 10/2011 | Radford et al. |
| 2003/0079913 | A1* | 5/2003 | Eppink ..... E21B 10/325 175/61 |
| 2003/0155155 | A1 | 8/2003 | Dewey et al. |
| 2004/0256113 | A1 | 12/2004 | LoGiudice et al. |
| 2005/0006106 | A1 | 1/2005 | Hirth et al. |
| 2005/0045342 | A1 | 3/2005 | Luke et al. |
| 2005/0145417 | A1 | 7/2005 | Radford et al. |
| 2005/0205305 | A1 | 9/2005 | Stout et al. |
| 2005/0236162 | A1 | 10/2005 | Badrak et al. |
| 2005/0241856 | A1 | 11/2005 | Lassoie et al. |
| 2006/0118339 | A1 | 6/2006 | Takhaundinov et al. |
| 2006/0124295 | A1 | 6/2006 | Maguire |
| 2006/0207797 | A1 | 9/2006 | Dewey et al. |
| 2006/0249307 | A1* | 11/2006 | Ritter ..... E21B 47/08 175/40 |
| 2007/0107937 | A1 | 5/2007 | Sugiura |
| 2007/0205022 | A1* | 9/2007 | Treviranus ..... E21B 7/06 175/61 |
| 2007/0285275 | A1 | 12/2007 | Purkis et al. |
| 2008/0041597 | A1 | 2/2008 | Fisher et al. |
| 2008/0128169 | A1 | 6/2008 | Radford et al. |
| 2008/0128174 | A1 | 6/2008 | Radford et al. |
| 2008/0128175 | A1 | 6/2008 | Radford et al. |
| 2008/0245532 | A1 | 10/2008 | Rhinehart et al. |
| 2009/0223670 | A1 | 9/2009 | Snider |
| 2009/0230340 | A1 | 9/2009 | Purkis |
| 2009/0266544 | A1 | 10/2009 | Redlinger et al. |
| 2010/0252252 | A1 | 10/2010 | Harris et al. |
| 2010/0252278 | A1 | 10/2010 | Harris et al. |
| 2011/0278064 | A1 | 11/2011 | Rasheed |

FOREIGN PATENT DOCUMENTS

| | | | |
|---|---|---|---|
| WO | 2004097163 | A1 | 11/2004 |
| WO | 2005124094 | A1 | 12/2005 |

OTHER PUBLICATIONS

Australian Patent Examination Report dated Mar. 19, 2015, for Australian Patent Application No. 2013203056.

Fraley et al.—"RFID Technology for Downhole Well Applications," Exploration & Production—Oil & Gas Review 2007—OTC Edition, pp. 60-62.

International Search Report and Written Opinion dated Feb. 25, 2010, International Application No. PCT/US2009/063934.

Australian Patent Examination Report No. 1, dated Nov. 23, 2012, Australian Application No. 2009313207.

Canadian Office Action; Canadian Patent Application No. 2,742,767; dated Aug. 15, 2012.

Gelfgat et al.—"Retractable Drillbit Technology—Drilling Without Pulling Out Drillpipe," Advanced Drilling Solutions Lessons from the FSU vol. II PennWell Corporation Tulsa Oklahoma 2003 pp. 365 430 432 and 435.

(56) References Cited

OTHER PUBLICATIONS

Canadian Office Action dated Jun. 25, 2013, Canadian Patent Application No. 2,742,767.
Canadian Office Action dated May 15, 2014, Canadian Patent Application No. 2,844,909.
EPO Search Report for European Application No. 13193719.5, dated Oct. 13, 2014.
Snider et al.—"RFID Downhole Tools and Development for the Drilling Environment", 2009 National AADE Technical Conference & Exhibition, New Orleans, Louisiana, AADE 2009NTCE-16-04, pp. 1-3.

* cited by examiner

EXTENDABLE CUTTING TOOLS FOR USE IN A WELLBORE

BACKGROUND OF THE INVENTION

Field of the Invention

Embodiments of the present invention generally relate to extendable cutting tools for use in a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. The second casing or liner string is then cemented. This process is typically repeated with additional casing or liner strings until the well has been drilled to total depth. In this manner, wells are typically formed with two or more strings of casing/liner of an ever-decreasing diameter.

As more casing/liner strings are set in the wellbore, the casing/liner strings become progressively smaller in diameter to fit within the previous casing/liner string. In a drilling operation, the drill bit for drilling to the next predetermined depth must thus become progressively smaller as the diameter of each casing/liner string decreases. Therefore, multiple drill bits of different sizes are ordinarily necessary for drilling operations. As successively smaller diameter casing/liner strings are installed, the flow area for the production of oil and gas is reduced. Therefore, to increase the annulus for the cementing operation, and to increase the production flow area, it is often desirable to enlarge the borehole below the terminal end of the previously cased/lined borehole. By enlarging the borehole, a larger annulus is provided for subsequently installing and cementing a larger casing/liner string than would have been possible otherwise. Accordingly, by enlarging the borehole below the previously cased borehole, the bottom of the formation can be reached with comparatively larger diameter casing/liner, thereby providing more flow area for the production of oil and/or gas. Underreamers also lessen the equivalent circulation density (ECD) while drilling the borehole.

In order to accomplish drilling a wellbore larger than the bore of the casing/liner, a drill string with an underreamer and pilot bit may be employed. Underreamers may include a plurality of arms which may move between a retracted position and an extended position. The underreamer may be passed through the casing/liner, behind the pilot bit when the arms are retracted. After passing through the casing, the arms may be extended in order to enlarge the wellbore below the casing.

SUMMARY OF THE INVENTION

Embodiments of the present invention generally relate to extendable cutting tools for use in a wellbore. In one embodiment, a tool for use in a wellbore includes a tubular body having a bore therethrough, an opening through a wall thereof, and a connector at each longitudinal end thereof; and an arm. The arm is pivotally connected to a first piston and rotationally coupled to the body. The arm is disposed in the opening in a retracted position, and is movable to an extended position where an outer surface of the arm extends outward past an outer surface of the body. The tool further includes the first piston. The first piston is disposed in the body bore, has a bore therethrough, and is operable to move the arm from the retracted position to the extended position in response to fluid pressure in the piston bore exceeding fluid pressure in the opening. The tool further includes a lock operable to retain the first piston in the retracted position; and a second piston operably coupled to the lock.

In another embodiment, a tool for use in a wellbore includes a tubular body having a bore therethrough and an opening through a wall thereof; and an arm. The arm is pivotally connected to the body or a first piston, disposed in the opening in a retracted position, and movable to an extended position where an outer surface of the arm extends outward past an outer surface of the body. The first piston is disposed in the body bore, has a bore therethrough, and is operable to move the arm from the retracted position to the extended position in response to fluid pressure in the piston bore exceeding fluid pressure in the opening. The tool further includes a lock operable to retain the piston in the retracted position; and a controller operable to release the lock in response to receiving an instruction signal.

In one aspect of the embodiment, the tool further includes a tachometer for measuring an angular speed of the body and in communication with the controller, wherein the controller is operable to receive the instruction signal using the tachometer. In another aspect of the embodiment, the tool further includes an antenna in communication with the controller, wherein the controller is operable to receive the instruction signal using the antenna. In another aspect of the embodiment, the tool further includes a pressure sensor or flow sensor, wherein the controller is operable to receive the instruction signal using the pressure or flow sensor. In another aspect of the embodiment, the tool further includes a mud pulser in communication with the controller, wherein the controller is operable to modulate the mud pulser to send a signal to the surface. In another aspect of the embodiment, the tool further includes a tachometer for measuring an angular speed of the body; and a pressure sensor or flow sensor and in communication with the controller, wherein the controller is operable to receive the instruction signal using either the tachometer or the pressure or flow sensor.

In another aspect of the embodiment, the tool further includes a sensor operable to measure a position of the first piston and in communication with the controller. Each of the body and the arm may have a shoulder and the shoulders may be engaged in the extended position. Each shoulder may be radially inclined to create a radially inward component of a normal reaction force between the arm and the body. In another aspect of the embodiment, the controller is operable to re-engage the lock in response to receiving a second instruction signal. The controller may also be operable to re-engage the lock when the arm is an intermediate position between the retracted and extended position. In another aspect of the embodiment, the tool further includes an actuator in communication with the controller, wherein the controller is operable to move the first piston toward the retracted position using the actuator, and the actuator is operable to move the first piston when fluid is being injected through the tool.

In another aspect of the embodiment, the tool may be used in a method including running a drilling assembly into the wellbore through a casing string, the drilling assembly comprising a tubular string, the tool, and a drill bit; injecting drilling fluid through the tubular string and rotating the drill bit, wherein the tool remains locked in the retracted position; sending an instruction signal from the surface to the tool, thereby extending the arm; and drilling and reaming the wellbore using the drill bit and the extended tool. The drilling assembly may further include a stabilizer and the instruction signal may also extend an arm of the stabilizer. The method may further include running an actuator through the tubular string to the tool using wireline or slickline; and retracting the arm using the actuator.

In another embodiment, a tool for use in a wellbore includes a tubular body having a bore therethrough and an opening through a wall thereof; and an arm. The arm is disposed in the opening in a retracted position, and movable to an extended position where an outer surface of the arm extends outward past an outer surface of the body. The tool further includes a first piston disposed in the body bore, having a bore therethrough, and operable to move the arm from the retracted position to the extended position in response to fluid pressure in the first piston bore exceeding fluid pressure in the opening. The tool further includes a lock operable to retain the first piston in the retracted position; a second piston operable to release the lock in response to fluid pressure; an actuator operable to move the piston and release the lock; and a controller operable to receive an instruction signal and operate the actuator.

In another embodiment, a method of drilling a wellbore includes running a drilling assembly into the wellbore through a casing string. The drilling assembly includes a tubular string, upper and lower underreamers, and a drill bit. The method further includes injecting drilling fluid through the tubular string and rotating the drill bit, wherein the underreamers remain locked in the retracted position; sending an instruction signal to the underreamers via modulation of a rotational speed of the drilling assembly, modulation of a drilling fluid injection rate, or modulation of a drilling fluid pressure, thereby extending one of the underreamers; and drilling and reaming the wellbore the drill bit and the extended underreamer; sending an instruction signal to the underreamers via modulation of a rotational speed of the drilling assembly, modulation of a drilling fluid injection rate, or modulation of a drilling fluid pressure, thereby extending the other of the underreamers; and drilling and reaming the wellbore using the drill bit and the extended other underreamer.

In another embodiment, a method of drilling a wellbore includes running a drilling assembly into the wellbore through a casing string, the drilling assembly including a tubular string, upper and lower underreamers, and a drill bit; injecting drilling fluid through the tubular string and rotating the drill bit, wherein the underreamers remain locked in the retracted position; sending an instruction signal to one of the underreamers, thereby extending one of the underreamers; drilling and reaming the wellbore the drill bit and the extended underreamer; pumping a closure member to the other of the underreamers or injecting drilling fluid through the drilling assembly at a flow rate greater than or equal to a predetermined flow rate, thereby extending the other of the underreamers; and drilling and reaming the wellbore using the drill bit and the extended other underreamer.

In another embodiment, a method of drilling a wellbore includes: running a drilling assembly into the wellbore through a casing string. The drilling assembly includes a tubular string, upper and lower underreamers, and a drill bit. The method further includes extending one of the underreamers; drilling and reaming a first geological formation using the drill bit and the extended underreamer; extending the other underreamer; and drilling and reaming a second geological formation using the drill bit and the extended other underreamer.

In another embodiment, a cutter for use in a wellbore, includes: a tubular body having a bore therethrough and an opening through a wall thereof; an arm disposed in the opening in a retracted position and movable to an extended position where an outer surface of the arm extends outward past an outer surface of the body; and a piston. The piston is disposed in the body bore, has a bore therethrough, and is operable to move the arm from the retracted position to the extended position in response to fluid pressure in the piston bore exceeding fluid pressure in the opening. The cutter further includes a controller operable to: receive a position signal from the surface, and move to a set position in response to the signal.

In another embodiment, a cutter for use in a wellbore includes a tubular body having a bore therethrough and an opening through a wall thereof; an arm disposed in the opening in a retracted position and movable to an extended position where an outer surface of the arm extends outward past an outer surface of the body; and a mandrel. The mandrel is disposed in the body bore, having a bore therethrough, and operable to move the arm from the retracted position to the extended position. The cutter further includes a controller operable to: receive a position signal from the surface, and move the mandrel to a set position in response to the position signal, thereby at least partially extending the arm.

In another embodiment, a method of cutting or milling a tubular cemented to a wellbore includes deploying a cutting assembly into the wellbore, the cutting assembly comprising a workstring and a cutter; sending an instruction signal to the cutter, thereby extending one or more arms of the cutter; and rotating the cutter, thereby milling or cutting the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1B:
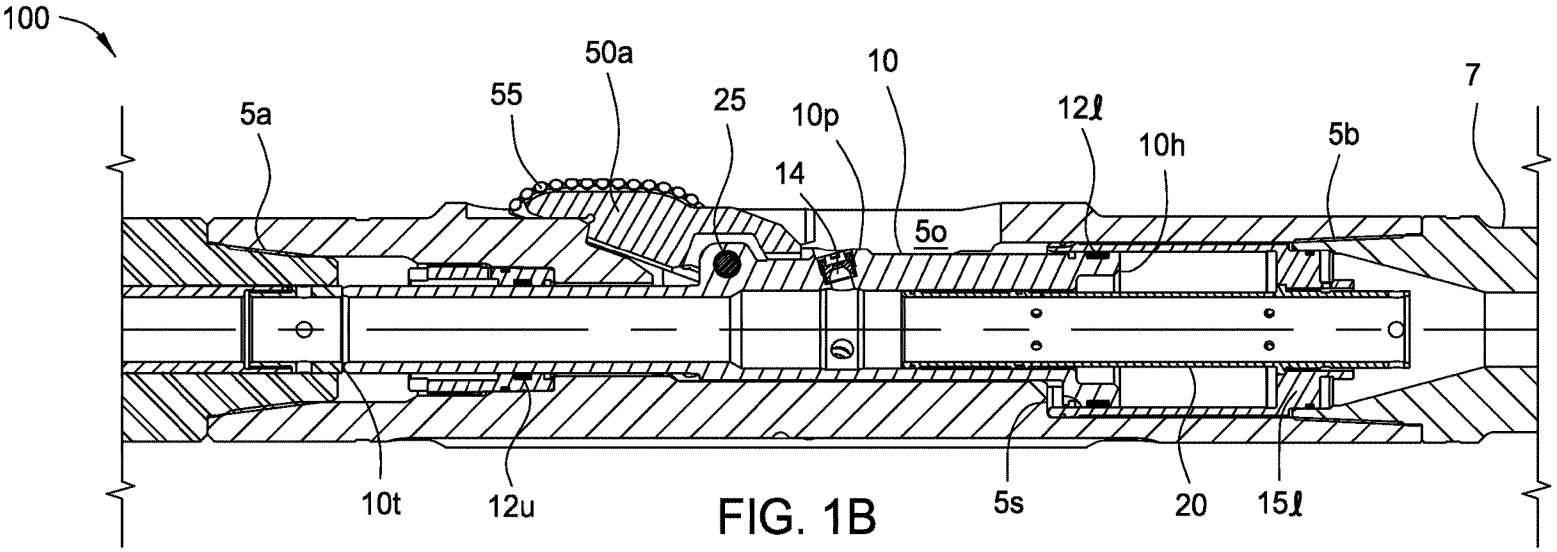
FIGS. 1A and 1B are cross-sections of an underreamer in a retracted and extended position, respectively, according to one embodiment of the present invention.
Figure 1A:
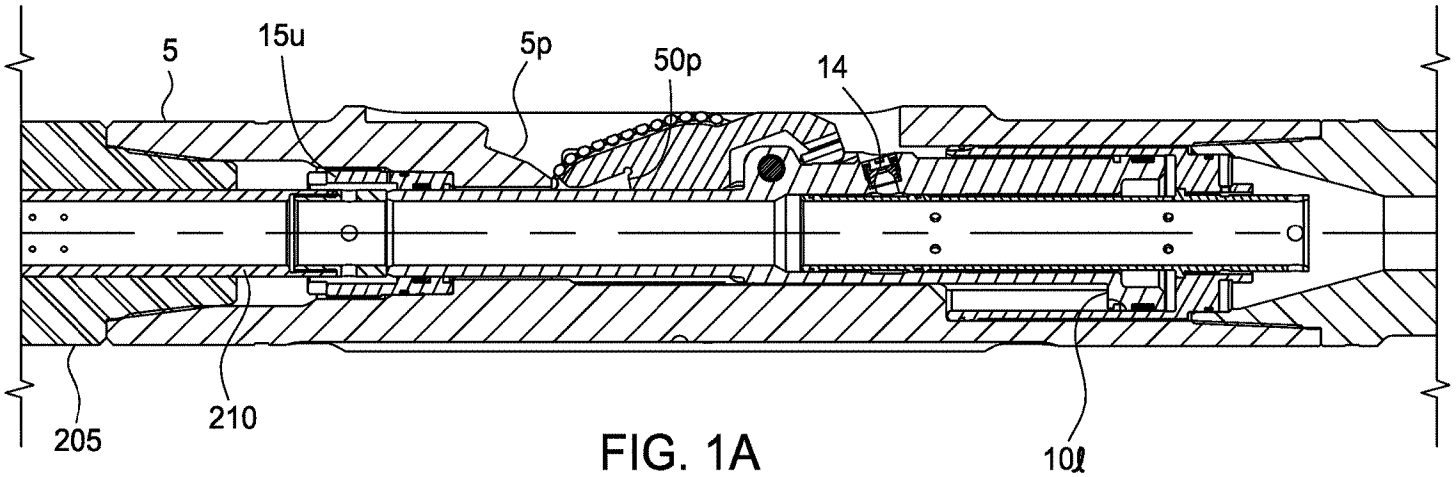

FIGS. 1A and 1B are cross-sections of an underreamer 100 in a retracted and extended position, respectively, according to one embodiment of the present invention.

Figure 1C:
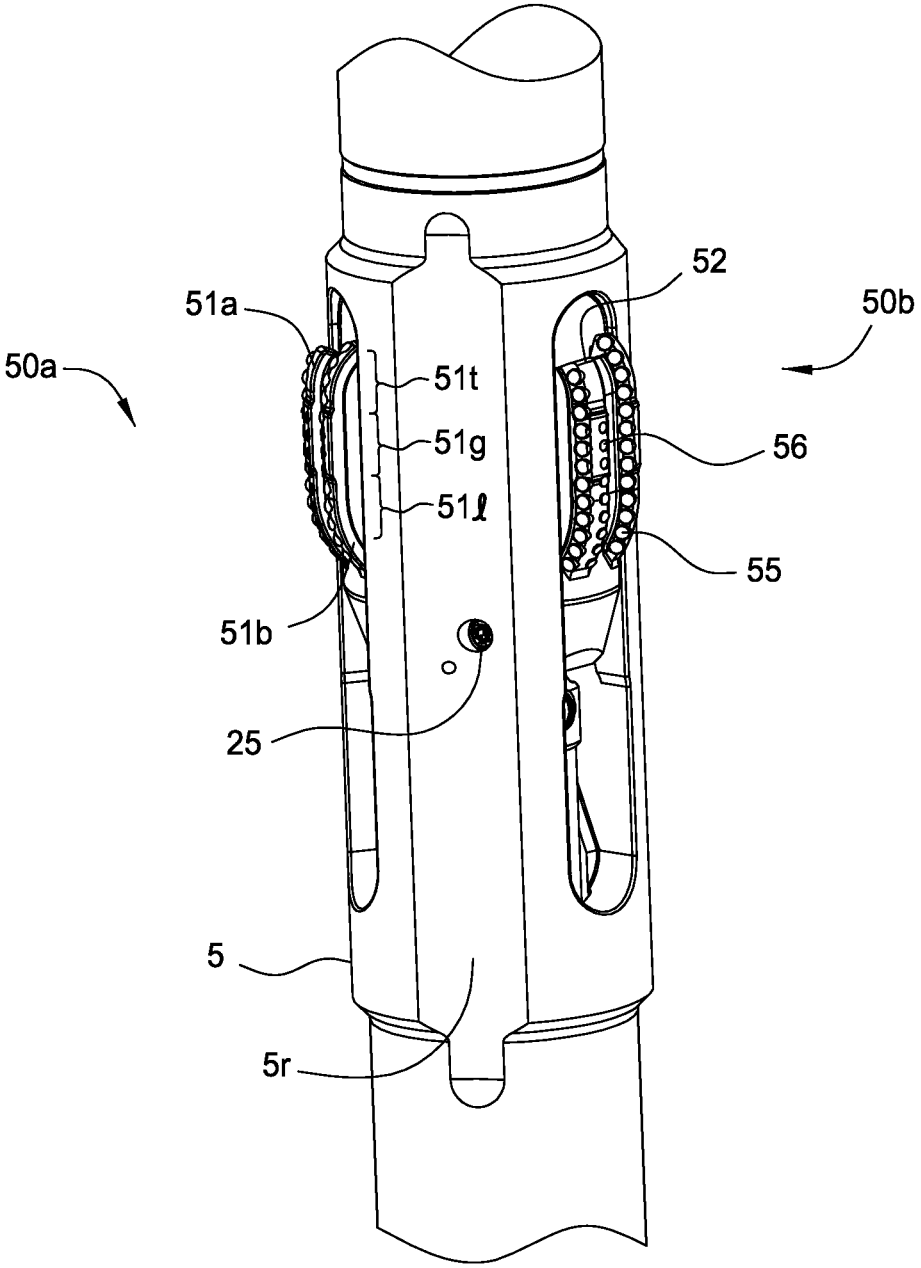
FIG. 1C is an isometric view of arms of the underreamer.

The underreamer 100 may include a body 5, an adapter 7, a piston 10, one or more seal sleeves 15*u,l*, a mandrel 20, and one or more arms 50*a,b* (see FIG. 1C for 50*b*). The body 5 may be tubular and have a longitudinal bore formed therethrough. Each longitudinal end 5*a,b* of the body 5 may be threaded for longitudinal and rotational coupling to other members, such as a control module 200 at 5*a* and the adapter 7 at 5*b*. The body 5 may have an opening 5*o* formed through a wall thereof for each arm 50*a,b*. The body 5 may also have a chamber formed therein at least partially defined by shoulder 5*s* for receiving a lower end of the piston 10 and the lower seal sleeve 15*l*. The body 5 may include an actuation profile 5*p* formed in a surface thereof for each arm 50*a,b* adjacent the opening 5*o*. An end of the adapter 7 distal from the body (not shown) may be threaded for longitudinal and rotational coupling to another member of a bottomhole assembly (BHA).

The piston 10 may be a tubular, have a longitudinal bore formed therethrough, and may be disposed in the body bore. The piston 10 may have a flow port 10*p* formed through a wall thereof corresponding to each arm 50*a,b*. A nozzle 14 may be disposed in each port 10*p* and made from an erosion resistant material, such as a metal, alloy, ceramic, or cermet. The mandrel 20 may be tubular, have a longitudinal bore formed therethrough, and be longitudinally coupled to the lower seal sleeve 15*l* by a threaded connection. The lower seal sleeve 15*l* may be longitudinally coupled to the body 5 by being disposed between the shoulder 5*s* and a top of the adapter 7. The upper seal sleeve 15*u* may be longitudinally coupled to the body 5 by a threaded connection.

Each arm 50*a,b* may be movable between an extended and a retracted position and may initially be disposed in the opening 5*o* in the retracted position. Each arm 50*a,b* may be pivoted to the piston 10 by a fastener 25. Each arm 50*a,b* may be biased radially inward by a torsion spring (not shown) disposed around the fastener 25. A surface of the body 5 defining each opening 5*o* may serve as a rotational stop for a respective blade 50*a,b*, thereby rotationally coupling the blade 50*a,b* to the body 5 (in both the extended and retracted positions). Each arm 50*a,b* may include an actuation profile 50*p* formed in an inner surface thereof corresponding to the profile 5*p*. Movement of each arm 50*a,b* along the actuation profile 5*p* may force the arm radially outward from the retracted position to the extended position. Each actuation profile 5*p*, 50*p* may include a shoulder. The shoulders may be inclined relative to a radial axis of the body 5 in order to secure each arm 50*a,b* to the body in the extended position so that the arms do not chatter or vibrate during reaming. The inclination of the shoulders may create a radial component of the normal reaction force between each arm and the body 5, thereby holding each arm 50*a,b* radially inward in the extended position. Additionally, the actuation profiles 5*p*, 50*p* may each be circumferentially inclined (not shown) to retain the arms 50*a,b* against a trailing surface of the body defining the opening 5*o* to further ensure against chatter or vibration.

The underreamer 100 may be fluid operated by drilling fluid injected through the drill string being at a high pressure and drilling fluid and cuttings, collectively returns, flowing to the surface via the annulus being at a lower pressure. A first surface 10*h* of the piston 10 may be isolated from a second surface 10*l* of the piston 10 by a lower seal 12*l* disposed between an outer surface of the piston 10 and an inner surface of the lower seal sleeve 15*l*. The lower seal 12*l* may be a ring or stack of seals, such as chevron seals, and made from a polymer, such as an elastomer. The high pressure may act on the first surface 10*h* of the piston via one or more ports formed through a wall of the mandrel 20 and the low pressure may act on the second surface 10*l* of the piston 10 via fluid communication with the openings 5*o*, thereby creating a net actuation force and moving the arms 50*a,b* from the retracted position to the extended position. An upper seal 12*u* may be disposed between the upper seal sleeve 15*u* and an outer surface of the piston 10 to isolate the openings 5*o*. The upper seal 12*u* may be a ring or stack of seals, such as chevron seals, and made from a polymer, such as an elastomer. Various other seals, such as o-rings may be disposed throughout the underreamer 100.

In the retracted position, the piston ports 10*p* may be closed by the mandrel 20 and straddled by seals, such as o-rings, to isolate the ports from the piston bore. In the extended position, the flow ports 10*p* may be exposed to the piston bore, thereby discharging a portion of the drilling fluid into the annulus to cool and lubricate the arms 50*a,b* and carry cuttings to the surface. This exposure of the flow ports 10*p* may result in a drop in upstream pressure, thereby providing an indication at the surface that the arms 50*a,b* are extended.

FIG. 1C is an isometric view of the arms 50*a,b*. An outer surface of each arm 50*a,b* may form one or more blades 51*a,b* and a stabilizer pad 52 between each of the blades. Cutters 55 may be bonded into respective recesses formed along each blade 51*a,b*. The cutters 55 may be made from a super-hard material, such as polycrystalline diamond compact (PDC), natural diamond, or cubic boron nitride. The PDC may be conventional, cellular, or thermally stable (TSP). The cutters 55 may be bonded into the recesses, such as by brazing, welding, soldering, or using an adhesive. Alternatively, the cutters 55 may be pressed or threaded into the recesses. Inserts, such as buttons 56, may be disposed along each pad 52. The inserts 56 may be made from a wear-resistant material, such as a ceramic or cermet (e.g., tungsten carbide). The inserts 56 may be brazed, welded, or pressed into recesses formed in the pad 52.

The arms 50*a,b* may be longitudinally aligned and circumferentially spaced around the body 5 and junk slots 5*r* may be formed in an outer surface of the body between the arms. The junk slots 5*r* may extend the length of the openings 5*o* to maximize cooling and cuttings removal (both from the drill bit and the underreamer). The arms 50*a,b* may be concentrically arranged about the body 5 to reduce vibration during reaming. The underreamer 100 may include a third arm (not shown) and each arm may be spaced at one-hundred twenty degree intervals. The arms 50*a,b* may be made from a high strength metal or alloy, such as steel. The blades 51*a,b* may each be arcuate, such as parabolic, semi-elliptical, semi-oval, or semi-super-elliptical. The arcuate blade shape may include a straight or substantially straight gage portion 51*g* and curved leading 51*l* and trailing 51*t* ends, thereby allowing for more cutters 55 to be disposed at the gage portion thereof and providing a curved actuation surface against a previously installed casing shoe when retrieving the underreamer 100 from the wellbore should the actuator spring be unable to retract the blades. Cutters 55 may be disposed on both a leading and trailing surface of each blade for back-reaming capability. The cutters in the leading and trailing ends of each blade may be super-flush with the blade. The gage portion may be raised and the gage-cutters flattened and flush with the blade, thereby ensuring a concentric and full-gage hole.

Alternatively, the cutters 55 may be omitted and the underreamer 100 may be used as a stabilizer instead.

Figure 2B:
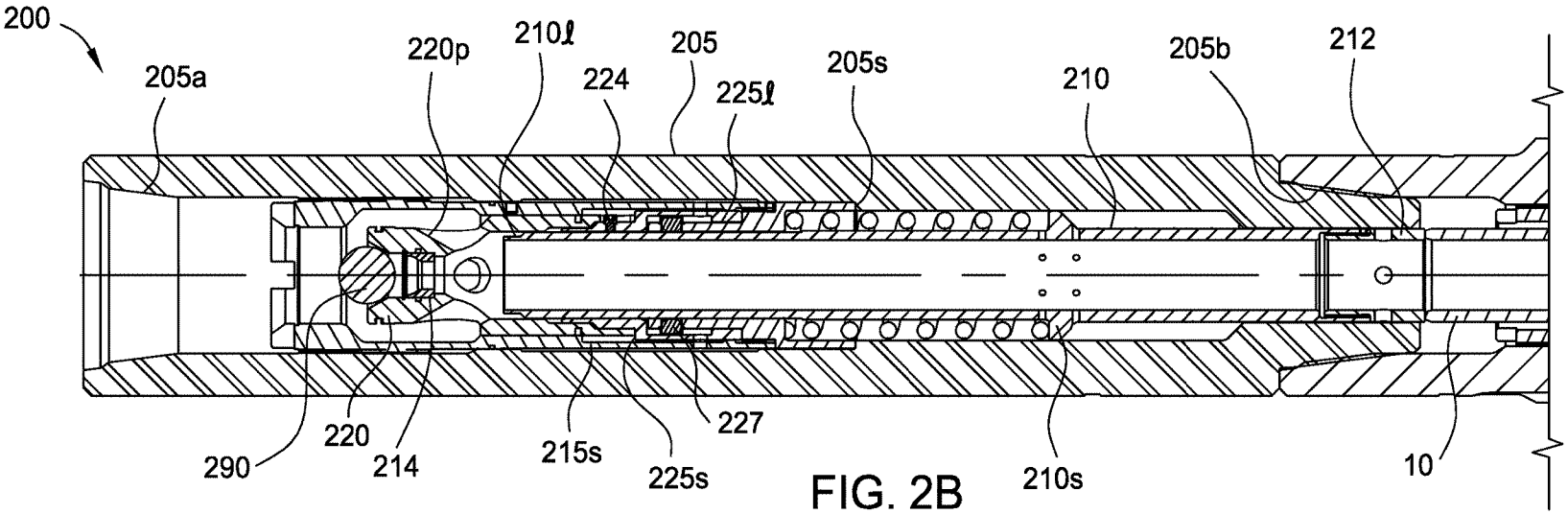
FIGS. 2A and 2B are cross-sections of a mechanical control module connected to the underreamer in a retracted and extended position, respectively, according to another embodiment of the present invention.
Figure 2A:
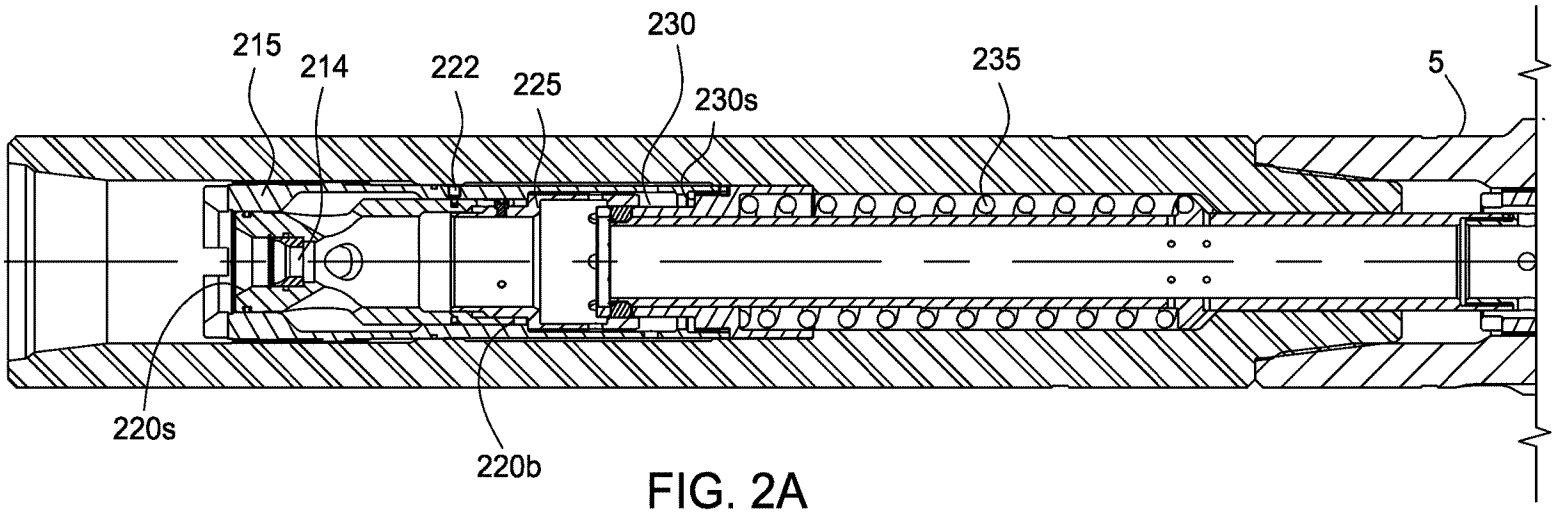

FIGS. 2A and 2B are cross-sections of a mechanical control module 200 connected to the underreamer 100 in a retracted and extended position, respectively, according to another embodiment of the present invention. The control module 200 may include a body 205, a control mandrel 210, a piston housing 215, a piston 220, a keeper 225, a lock mandrel 230, and a biasing member 235. The body 205 may be tubular and have a longitudinal bore formed therethrough. Each longitudinal end 205*a,b* of the body 205 may be threaded for longitudinal and rotational coupling to other members, such as the underreamer 100 at 205*b* and a drill string at 205*a*.

The biasing member may be a spring 235 and may be disposed between a shoulder 210*s* of the control mandrel 210 and a shoulder of the lock mandrel 230. The spring 235 may bias a longitudinal end of the control mandrel or a control module adapter 212 into abutment with the underreamer piston end 10*t*, thereby also biasing the underreamer piston 210 toward the retracted position. The control module adapter 212 may be longitudinally coupled to the control mandrel 210, such as by a threaded connection, and may allow the control module 200 to be used with differently configured underreamers by changing the adapter 212. The control mandrel 210 may be longitudinally coupled to the lock mandrel 230 by a latch or lock, such as a plurality of dogs 227. Alternatively, the latch or lock may be a collet. The dogs 227 may be held in place by engagement with a lip 225*l* of the keeper 225 and engagement with a lip 210*l* of the control mandrel 210. The lock mandrel 230 may be longitudinally coupled to the piston housing 215 by a threaded connection and may abut a body shoulder 205*s* and the piston housing 215.

The piston housing 215 may be longitudinally coupled to the body 205 by a threaded connection. The piston 220 may be longitudinally coupled to the keeper 225 by one or more fasteners, such as set screws 224, and by engagement of a piston end 220*b* with a keeper shoulder 225*s*. The set screws 224 may each be disposed through a respective slot formed through a wall of the piston 220 so that the piston may move longitudinally relative to the keeper 225, the movement limited by a length of the slot. The keeper 225 may be longitudinally movable relative to the body 205, the movement limited by engagement of the keeper shoulder 225*s* with a piston housing shoulder 215*s* and engagement of a keeper longitudinal end with a lock mandrel shoulder 230*s*. The piston 220 may be longitudinally coupled to the piston housing 215 by one or more frangible fasteners, such as shear screws 222. The piston 220 may have a seat 220*s* formed therein for receiving a closure element, such as a ball 290, plug, or dart. A nozzle 214 may be disposed in a bore of the piston 220 and made from an erosion resistant material, such as a metal, alloy, ceramic, or cermet.

When deploying the underreamer 100 and control module 200 in the wellbore, a drilling operation (e.g., drilling through a casing shoe) may be performed without operation of the underreamer 100. Even though force is exerted on the underreamer piston 10 by drilling fluid, the shear screws 222 may prevent the underreamer piston 10 from extending the arms 50*a,b*. When it is desired to operate the underreamer 100, the ball 290 is pumped or dropped from the surface and lands in the ball seat 220*s*. Drilling fluid continues to be injected or is injected through the drill string. Due to the obstructed piston bore, fluid pressure acting on the ball 290 and piston 220 increases until the shear screws 222 are fractured, thereby allowing the piston to move longitudinally relative to the body 205. The piston end 220*b* may then engage the keeper shoulder 225*s* and push the keeper 225 longitudinally relative to the body 205, thereby disengaging the keeper lip 225*l* from the dogs 227. The control mandrel lip 210*l* may be inclined and force exerted on the control mandrel 210 by the underreamer piston 10 may push the dogs 227 radially outward into a radial gap defined between the lock mandrel 230 and the keeper 225, thereby freeing the control mandrel and allowing the underreamer piston 10 to extend the arms 50*a,b*. Movement of the piston 220 may also expose a piston housing bore and place bypass ports 220*p* formed through a wall of the piston 220 in fluid communication therewith.

Alternatively, the control mandrel 210 may be released by increasing an injection rate of the drilling fluid to or past a predetermined flow rate instead of using the ball 290. The casing shoe may be drilled through without operation of the underreamer 100 by maintaining the injection rate below or substantially below the predetermined flow rate. When the injection rate of the drilling fluid is increased to or past the predetermined rate, the drilling fluid is choked through the nozzle 214, thereby exerting a longitudinal force on the piston 220 downward or toward the underreamer 100. Simultaneously, the underreamer piston 10 exerts longitudinal force via the control mandrel 210 onto dogs 227 upward or toward the body connector 205*a*, thereby pushing the dogs 227 radially against the keeper 225 and exerting a longitudinal friction force on the keeper 225 upward or toward the body connector 205*a*. If the piston 220 and keeper 225 were a single integral piece, the friction force would counteract the piston force created by differential pressure across the nozzle 214. By allowing the initial longitudinal movement between piston 220 and keeper 225, the piston 220 may fracture the screws 222 first without having to overcome the friction force as well and then engage the keeper 225 and overcome the isolated friction force.

Alternatively, if the flow rate operation option is not needed, the nozzle 214 may be omitted and the keeper 225 and piston 220 may be formed as an integral piece, thereby also omitting the fastener 224.

Figure 3:
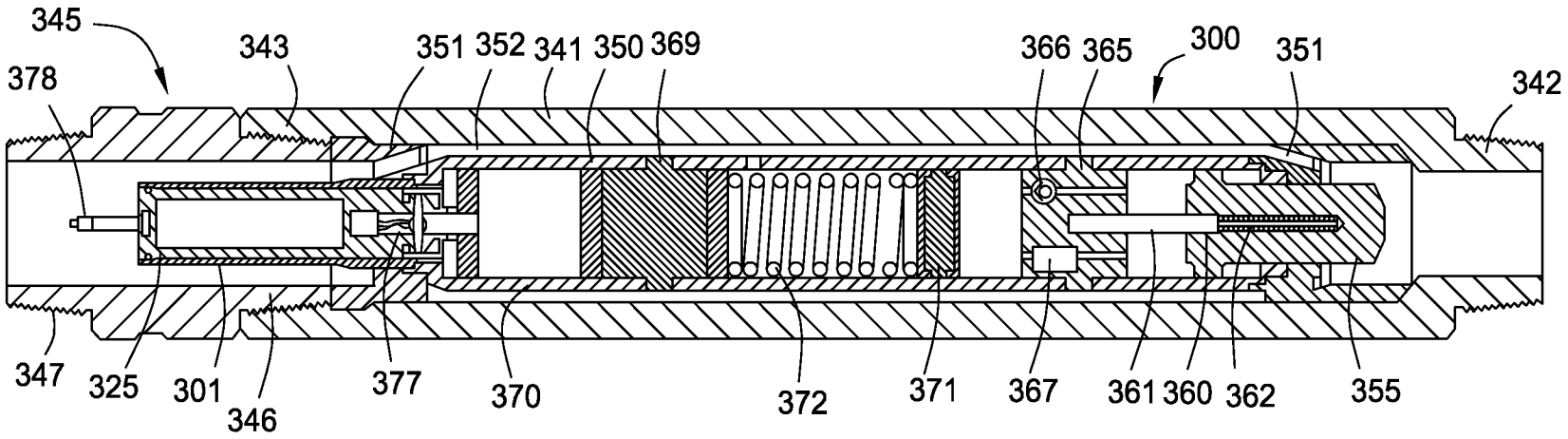
FIG. 3 illustrates an electro-hydraulic control module for use with the underreamer, according to another embodiment of the present invention.

FIG. 3 illustrates an electro-hydraulic control module 300 for use with the underreamer 100, according to another embodiment of the present invention. The control module 300 may be used instead of the control module 200. The control module 300 may include an outer tubular body 341. The lower end of the body 341 may include a threaded coupling, such as pin 342, connectable to the threaded end 5*a* of the underreamer 100. The upper end of the body 341 may include a threaded coupling, such as box 343, connected to a threaded coupling, such as lower pin 346, of the retainer 345. The retainer 345 may have threaded couplings, such as pins 346 and 347, formed at its ends. The upper pin 347 may connect to a threaded coupling, such as box 408*b*, of a telemetry sub 400.

The tubular body 341 may house an interior tubular body 350. The inner body 350 may be concentrically supported within the tubular body 341 at its ends by support rings 351. The support rings 351 may be ported to allow drilling fluid flow to pass into an annulus 352 formed between the two bodies 341, 350. The lower end of tubular body 350 may slidingly support a positioning piston 355, the lower end of which may extend out of the body 350 and may engage piston end 10*t*.

The interior of the piston 355 may be hollow in order to receive a longitudinal position sensor 360. The position sensor 360 may include two telescoping members 361 and 362. The lower member 362 may be connected to the piston 355 and be further adapted to travel within the first member 361. The amount of such travel may be electronically measured. The position sensor 360 may be a linear potentiometer. The upper member 361 may be attached to a bulkhead 365 which may be fixed within the tubular body 350.

The bulkhead 365 may have a solenoid operated valve 366 and passage extending therethrough. The bulkhead 365 may further include a pressure switch 367 and passage. A conduit tube (not shown) may be attached at its lower end to the bulkhead 365 and at its upper end to and through a second bulkhead 369 to provide electrical communication for the position sensor 360, the solenoid valve 366, and the pressure switch 367, to a battery pack 370 located above the second bulkhead 369. The batteries may be high temperature lithium batteries. A compensating piston 371 may be slidingly positioned within the body 350 between the two bulkheads 365,369. A spring 372 may be located between the piston 371 and the second bulkhead 369, and the chamber containing the spring may be vented to allow the entry of drilling fluid.

A tube 301 may be disposed in the connector sub 345 and may house an electronics package 325. The electronics package 325 may include a controller, such as microprocessor, power regulator, and transceiver. Electrical connections 377 may be provided to interconnect the power regulator to the battery pack 370. A data connector 378 may be provided for data communication between the microprocessor 325 and the telemetry sub 400. The data connector may include a short-hop electromagnetic telemetry antenna 378.

Hydraulic fluid (not shown), such as oil, may be disposed in a lower chamber defined by the positioning piston 355, the bulkhead 365, and the body 350 and an upper chamber defined by the compensating piston 371, the bulkhead 365, and the body 350. The spring 372 may bias the compensating piston 371 to push hydraulic oil from the upper reservoir, through the bulkhead passage and valve, thereby extending the positioning piston into engagement with the underreamer piston 10 and biasing the underreamer piston toward the retracted position. Alternatively, the underreamer 100 may include its own return spring and the spring 372 may be used maintain engagement of the positioning piston 355 with the underreamer piston 10. The solenoid valve 366 may be a check valve operable between a closed position where the valve functions as a check valve oriented to prevent flow from the lower chamber to the upper chamber and allow reverse flow therethrough, thereby fluidly locking the underreamer 100 in the retracted position and an open position where the valve allows flow through the passage (in either direction). Alternatively, a solenoid operate shutoff valve may be used instead of the check valve. To allow extension of the underreamer 100, the valve 366 may be opened when drilling fluid is flowing. The underreamer piston 10 may then actuate and push the positioning piston 355 toward the lower bulkhead 365.

The position sensor 360 may measure the position of the piston 355. The controller 325 may monitor the sensor 360 to verify that the piston 355 has been actuated. The differential pressure switch 367 in the lower bulkhead 365 may verify that the underreamer piston 10 has made contact with the positioning piston 355. The force exerted on the piston 355 by the underreamer piston 310 may cause a pressure increase on that side of the bulkhead. Additionally, the underreamer 100 may be modified to be variable (see section mill 1100) and the controller 325 may close the valve 366 before the underreamer arms 50*a,b* are fully extended, thereby allowing the underreamer 100 to have one or more intermediate positions. Additionally, the controller may lock and unlock the underreamer 100 repeatedly.

In operation, the control module 300 may receive an instruction signal from the surface (discussed below). The instruction signal may direct the control module 300 to allow full or partial extension of the arms 50*a,b*. The controller 325 may open the solenoid valve 366. If drilling fluid is being circulated through the BHA, the underreamer piston 10 may then extend the arms 50*a,b*. During extension, the controller 325 may monitor the arms using the pressure sensor 367 and the position sensor 361. Once the arms have reached the instructed position, the controller 325 may close the valve 366, thereby preventing further extension of the arms. The controller 325 may then report a successful extension of the arms or an error if the arms are obstructed from the instructed extension. Once the underreamer operation has concluded, the control module 300 may receive a second instruction signal to retract the arms. If the valve 366 is the check valve, the controller may open the valve or may not have to take action as the check valve may allow for hydraulic fluid to flow from the upper chamber to the lower chamber regardless of whether the valve is open or closed. The controller may simply monitor the position sensor and report successful retraction of the arms. If the valve 366 is a shutoff valve, the instruction signal may include a time at which the rig pumps are shut off or the controller 325 may wait for indication from the telemetry sub that the rig pumps are shut off. The controller may then open the valve to allow the retraction of the arms. Since the control module may not force retraction of the arms 50*a,b* the control module may be considered a passive control module. Advantageously, the passive control module may use less energy to operate than an active control module (discussed below).

As shown, components of the control module 300 are disposed in a bore of the body 341 and connector 345. Alternatively, components of the control module may be disposed in a wall of the body 341, similar to the telemetry sub 400. The center configured control module 300 may allow for: stronger outer collar connections, a single size usable for different size underreamers or other downhole tools, and easier change-out on the rig floor. The annular alternative arranged control module may provide a central bore therethrough so that tools, such as a ball, may be run-through or dropped through the drill string.

Additionally, as illustrated in FIG. 7 of the '198 provisional, a latch, such as a collet, may be formed in an outer surface of the position piston 355. A corresponding profile may be formed in an inner surface of the interior body 350. The latch may engage the profile when the position piston is in the retracted position. The latch may transfer at least a substantial portion of the underreamer piston 10 force to the interior body 350 when drilling fluid is injected through the underreamer 100, thereby substantially reducing the amount of pressure required in the lower hydraulic chamber to restrain the underreamer piston.

Figure 4:
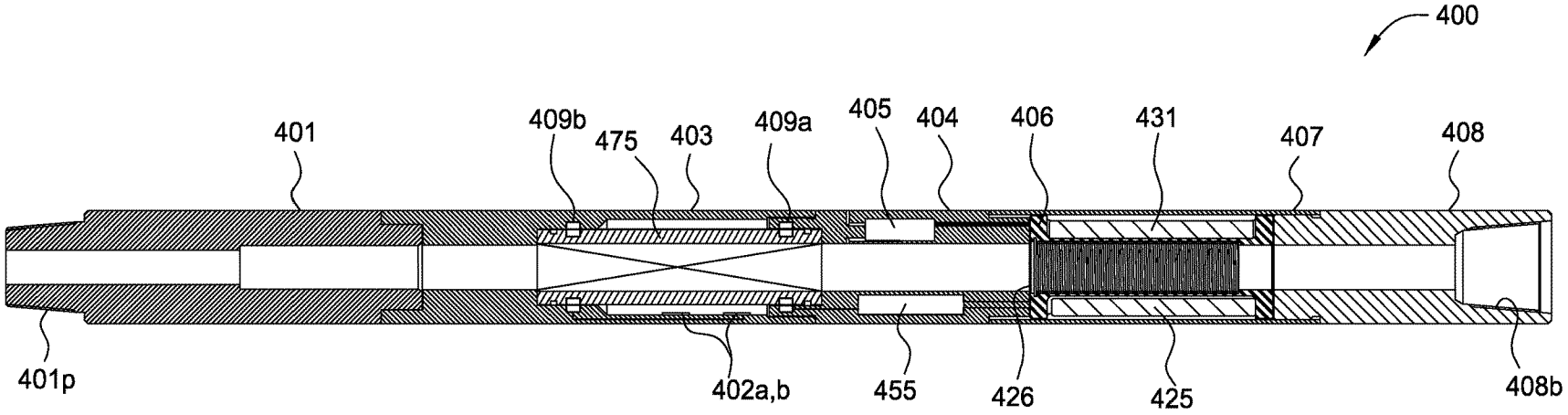
FIG. 4 illustrates a telemetry sub for use with the control module, according to another embodiment of the present invention.

FIG. 4 illustrates a telemetry sub 400 for use with the control module 300, according to another embodiment of the present invention. The telemetry sub 400 may include an upper adapter 401, one or more auxiliary sensors 402*a,b*, an uplink housing 403, a sensor housing 404, a pressure sensor 405, a downlink mandrel 406, a downlink housing 407, a lower adapter 408, one or more data/power couplings 409*a,b*, an electronics package 425, an antenna 426, a battery 431, accelerometers 455, and a mud pulser 475. The housings 403, 404, 407 may each be modular so that any of the housings 403, 404, 407 may be omitted and the rest of the housings may be used together without modification thereof. Alternatively, any of the sensors or electronics of the telemetry sub 400 may be incorporated into the control module 300 and the telemetry sub 400 may be omitted.

The adapters 401,408 may each be tubular and have a threaded coupling 401*p*, 408*b* formed at a longitudinal end thereof for connection with the control module 300 and the drill string. Each housing may be longitudinally and rotationally coupled together by one or more fasteners, such as screws (not shown), and sealed by one or more seals, such as o-rings (not shown).

The sensor housing 404 may include the pressure sensor 405 and a tachometer 455. The pressure sensor 405 may be in fluid communication with a bore of the sensor housing via a first port and in fluid communication with the annulus via a second port. Additionally, the pressure sensor 405 may also measure temperature of the drilling fluid and/or returns. The sensors 405,455 may be in data communication with the electronics package 425 by engagement of contacts disposed at a top of the mandrel 406 with corresponding contacts disposed at a bottom of the sensor housing 406. The sensors 405,455 may also receive electricity via the contacts. The sensor housing 404 may also relay data between the mud pulser 475, the auxiliary sensors 402*a,b*, and the electronics package 425 via leads and radial contacts 409*a,b*.

The auxiliary sensors 402*a,b* may be magnetometers which may be used with the accelerometers for determining directional information, such as azimuth, inclination, and/or tool face/bent sub angle.

The antenna 426 may include an inner liner, a coil, and an outer sleeve disposed along an inner surface of the downlink mandrel 406. The liner may be made from a non-magnetic and non-conductive material, such as a polymer or composite, have a bore formed longitudinally therethrough, and have a helical groove formed in an outer surface thereof. The coil may be wound in the helical groove and made from an electrically conductive material, such as a metal or alloy. The outer sleeve may be made from the non-magnetic and non-conductive material and may be insulate the coil from the downlink mandrel 406. The antenna 426 may be longitudinally and rotationally coupled to the downlink mandrel 406 and sealed from a bore of the telemetry sub 400.

Figure 4A:
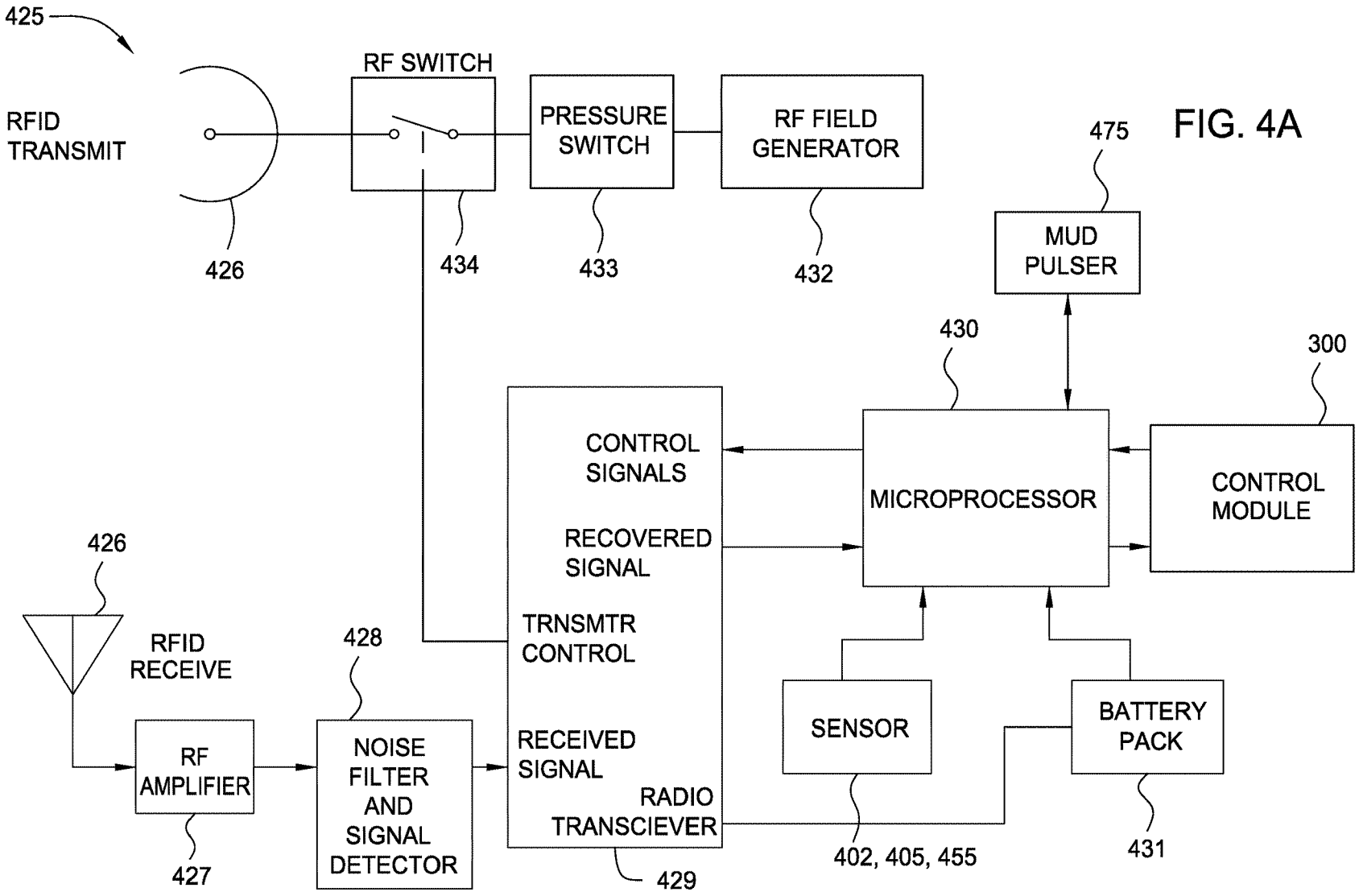
FIG. 4A illustrates an electronics package of the telemetry sub.
Figure 4B:
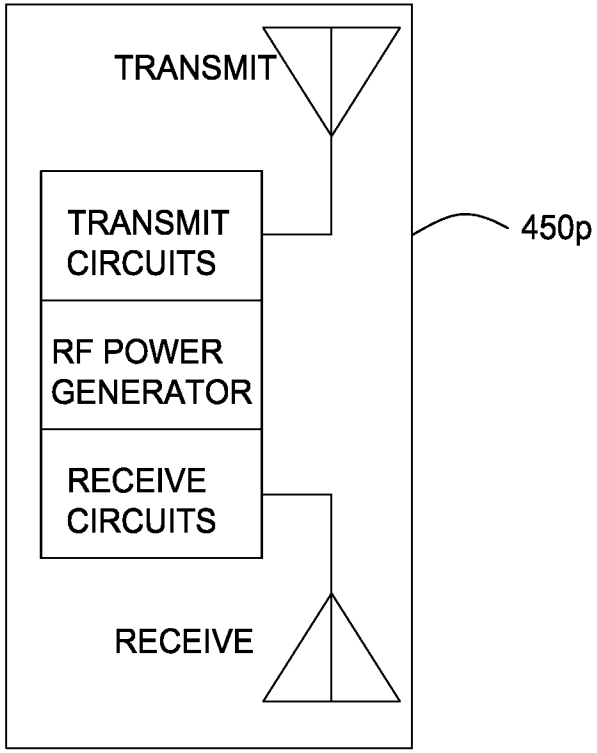
FIG. 4B illustrates an active RFID tag and a passive RFID tag for use with the telemetry sub.
Figure 4B:
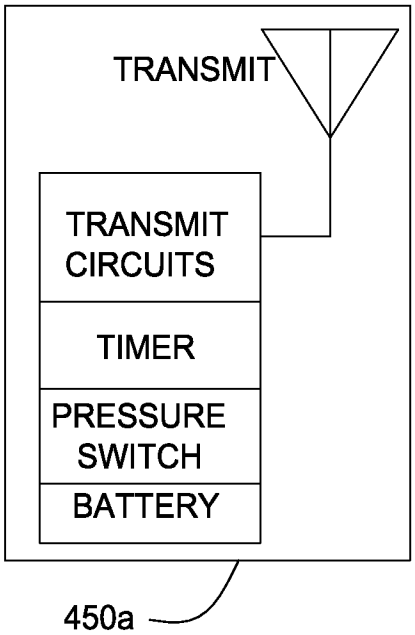

FIG. 4A illustrates the electronics package 425. FIG. 4B illustrates an active RFID tag 450*a* and a passive RFID tag 450*p*. The electronics package 425 may communicate with a passive RFID tag 450*p* or an active RFID tag 450*a*. Either of the RFID tags 450*a,p* may be individually encased and dropped or pumped through the drill string. The electronics package 425 may be in electrical communication with the antenna 426 and receive electricity from the battery 431. Alternatively, the data sub 400 may include a separate transmitting antenna and a separate receiving antenna. The electronics package 425 may include an amplifier 427, a filter and detector 428, a transceiver 429, a microprocessor 430, an RF switch 434, a pressure switch 433, and an RF field generator 432.

The pressure switch 433 may remain open at the surface to prevent the electronics package 425 from becoming an ignition source. Once the data sub 400 is deployed to a sufficient depth in the wellbore, the pressure switch 433 may close. The microprocessor 430 may also detect deployment in the wellbore using pressure sensor 405. The microprocessor 430 may delay activation of the transmitter for a predetermined period of time to conserve the battery 431.

When it is desired to operate the underreamer 100, one of the tags 450*a,p* may be pumped or dropped from the surface to the antenna 426. If a passive tag 450*p* is deployed, the microprocessor 430 may begin transmitting a signal and listening for a response. Once the tag 450*p* is deployed into proximity of the antenna 426, the passive tag 450*p* may receive the signal, convert the signal to electricity, and transmit a response signal. The antenna 426 may receive the response signal and the electronics package 425 may amplify, filter, demodulate, and analyze the signal. If the signal matches a predetermined instruction signal, then the microprocessor 430 may communicate the signal to the underreamer control module 300 using the antenna 426 and the transmitter circuit. The instruction signal carried by the tag 450*a,p* may include an address of a tool (if the BHA includes multiple underreamers and/or stabilizers, discussed below) and a set position (if the underreamer/stabilizer is adjustable).

If an active tag 450*a* is used, then the tag 450*a* may include its own battery, pressure switch, and timer so that the tag 450*a* may perform the function of the components 432-434. Further, either of the tags 450*a,p* may include a memory unit (not shown) so that the microprocessor 430 may send a signal to the tag and the tag may record the signal. The signal may then be read at the surface. The signal may be confirmation that a previous action was carried out or a measurement by one of the sensors. The data written to the RFID tag may include a date/time stamp, a set position (the command), a measured position (of control module position piston), and a tool address. The written RFID tag may be circulated to the surface via the annulus.

Alternatively, the control module 300 may be hard-wired to the telemetry sub 400 and a single controller, such as a microprocessor, disposed in either sub may control both subs. The control module 300 may be hard-wired by replacing the data connector 378 with contact rings disposed at or near the pin 347 and adding corresponding contact rings to/near the box 408*b* of the telemetry sub 400. Alternatively, inductive couplings may be used instead of the contact rings. Alternatively, a wet or dry pin and socket connection may be used instead of the contact rings.

Figure 4D:
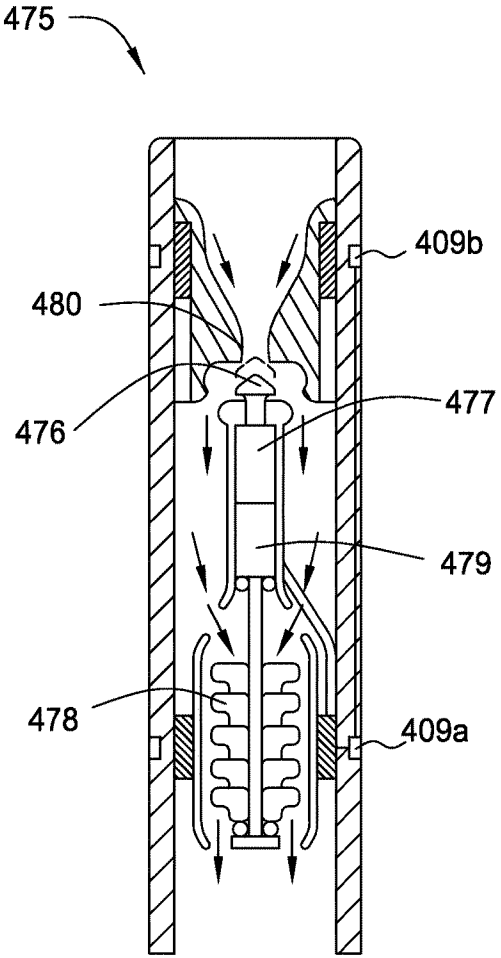
FIG. 4D illustrates a mud pulser of the telemetry sub.
Figure 4C:
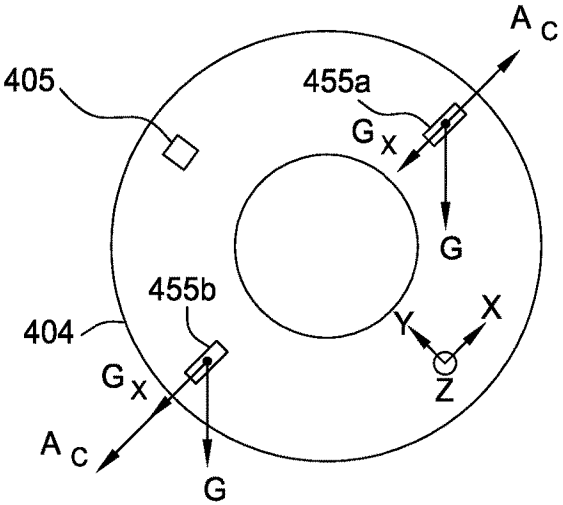
FIG. 4C illustrates accelerometers of the telemetry sub.

FIG. 4C is a schematic cross-sectional view of the sensor sub 404. The tachometer 455 may include two diametrically opposed single axis accelerometers 455*a,b*. The accelerometers 455*a,b* may be piezoelectric, magnetostrictive, servo-controlled, reverse pendular, or microelectromechanical (MEMS). The accelerometers 455*a,b* may be radially X oriented to measure the centrifugal acceleration $A_c$ due to rotation of the telemetry sub 400 for determining the angular speed. The second accelerometer may be used to account for gravity G if the telemetry sub is used in a deviated or horizontal wellbore. Detailed formulas for calculation of the angular speed are discussed and illustrated in U.S. Pat. App. Pub. No. 2007/0107937, which is herein incorporated by reference in its entirety. Alternatively, as discussed in the '937 publication, the accelerometers may be tangentially Y oriented, dual axis, and/or asymmetrically arranged (not diametric and/or each accelerometer at a different radial location). Further, as discussed in the '937 publication, the accelerometers may be used to calculate borehole inclination and gravity tool face. Further, the sensor sub may include a longitudinal Z accelerometer. Alternatively, magnetometers may be used instead of accelerometers to determine the angular speed.

Instead of using one of the RFID tags 450*a,p* to activate the underreamer 100, an instruction signal may be sent to the controller 430 by modulating angular speed of the drill string according to a predetermined protocol. An exemplary signal is illustrated in FIG. 10 of the '937 publication. The modulated angular speed may be detected by the tachometer 455. The controller 430 may then demodulate the signal and relay the signal to the control module controller 325, thereby operating the underreamer 100. The protocol may represent data by varying the angular speed on to off, a lower speed to a higher speed and/or a higher speed to a lower speed, or monotonically increasing from a lower speed to a higher speed and/or a higher speed to a lower speed.

FIG. 4D illustrates the mud pulser 475. The mud pulser 475 may include a valve, such as a poppet 476, an actuator 477, a turbine 478, a generator 479, and a seat 480. The poppet 476 may be longitudinally movable by the actuator 477 relative to the seat 480 between an open position (shown) and a choked position (dashed) for selectively restricting flow through the pulser 475, thereby creating pressure pulses in drilling fluid pumped through the mud pulser. The mud pulses may be detected at the surface, thereby communicating data from the microprocessor to the surface. The turbine 478 may harness fluid energy from the drilling fluid pumped therethrough and rotate the generator 479, thereby producing electricity to power the mud pulser. The mud pulser may be used to send confirmation of receipt of commands and report successful execution of commands or errors to the surface. The confirmation may be sent during circulation of drilling fluid. Alternatively, a negative or sinusoidal mud pulser may be used instead of the positive mud pulser 475. The microprocessor may also use the turbine 478 and/or pressure sensor as a flow switch and/or flow meter.

Instead of using one of the RFID tags 450*a,p* or angular speed modulation to activate the underreamer 100, a signal may be sent to the controller by modulating a flow rate of the rig drilling fluid pump according to a predetermined protocol. Alternatively, a mud pulser (not shown) may be installed in the rig pump outlet and operated by the surface controller to send pressure pulses from the surface to the telemetry sub controller according to a predetermined protocol. The telemetry sub controller may use the turbine and/or pressure sensor as a flow switch and/or flow meter to detect the sequencing of the rig pumps/pressure pulses. The flow rate protocol may represent data by varying the flow rate on to off, a lower speed to a higher speed and/or a higher speed to a lower speed, or monotonically increasing from a lower speed to a higher speed and/or a higher speed to a lower speed. Alternatively, an orifice flow switch or meter may be used to receive pressure pulses/flow rate signals communicated through the drilling fluid from the surface instead of the turbine and/or pressure sensor. Alternatively, the sensor sub may detect the pressure pulses/flow rate signals using the pressure sensor and accelerometers to monitor for BHA vibration caused by the pressure pulse/flow rate signal.

Alternatively, an electromagnetic (EM) gap sub (not shown) may be used instead of the mud pulser, thereby allowing data to be transmitted to the surface using EM waves. Alternatively, an RFID tag launcher (not shown) may be used instead of the mud pulser. The tag launcher may include one or more RFID tags. The microprocessor 430 may then encode the tags with data and the launcher may release the tags to the surface. Alternatively, an acoustic transmitter may be used instead of the mud pulser. Alternatively, and as discussed above, instead of the mud pulser, RFID tags may be periodically pumped through the telemetry sub and the microprocessor may send the data to the tag. The tag may then return to the surface via an annulus formed between the workstring and the wellbore. The data from the tag may then be retrieved at the surface. Alternatively, and as discussed above, instruction signals may be sent to the electronics package using mud pulses, EM waves, or acoustic signals.

For deeper wells, the drill string may further include a signal repeater (not shown) to prevent attenuation of the transmitted mud pulse. The repeater may detect the mud pulse transmitted from the mud pulser 475 and include its own mud pulser for repeating the signal. As many repeaters may be disposed along the workstring as necessary to transmit the data to the surface, e.g., one repeater every five thousand feet. Each repeater may also be a telemetry sub and add its own measured data to the retransmitted data signal. If the mud pulser is being used, the repeater may wait until the data sub is finished transmitting before retransmitting the signal. The repeaters may be used for any of the mud pulser alternatives, discussed above. Repeating the transmission may increase bandwidth for the particular data transmission.

Alternatively, multiple telemetry subs may be deployed in a workstring or drill string. An RFID tag including a memory unit may be dropped/pumped through the telemetry subs and record the data from the telemetry subs until the tag reaches a bottom of the data subs. The tag may then transmit the data from the upper subs to the bottom sub and then the bottom sub may transmit all of the data to the surface.

Alternatively, the mud pulser may instead be located in a measurement while drilling (MWD) and/or logging while drilling (LWD) tool assembled in the drill string downstream of the underreamer. The MWD/LWD module may be located in the BHA to receive written RFID tags from several upstream tools. The mud pulse module or MWD/LWD module may then pulse a signal to the surface indicating time to shut down pumps to allow passive activation. Alternatively, the mud pulse module or MWD/LWD module may send a mud-pulse to annulus pressure measurement module (PWD subs) along the drill string. The PWD module may then upon command, or periodically, write RFID tags and eject the tags into the annulus for telemetry to surface or into the bore for telemetry to the MWD/LWD module.

Alternatively, the control module may send and receive instructions via wired drill/casing string.

Figure 5A:
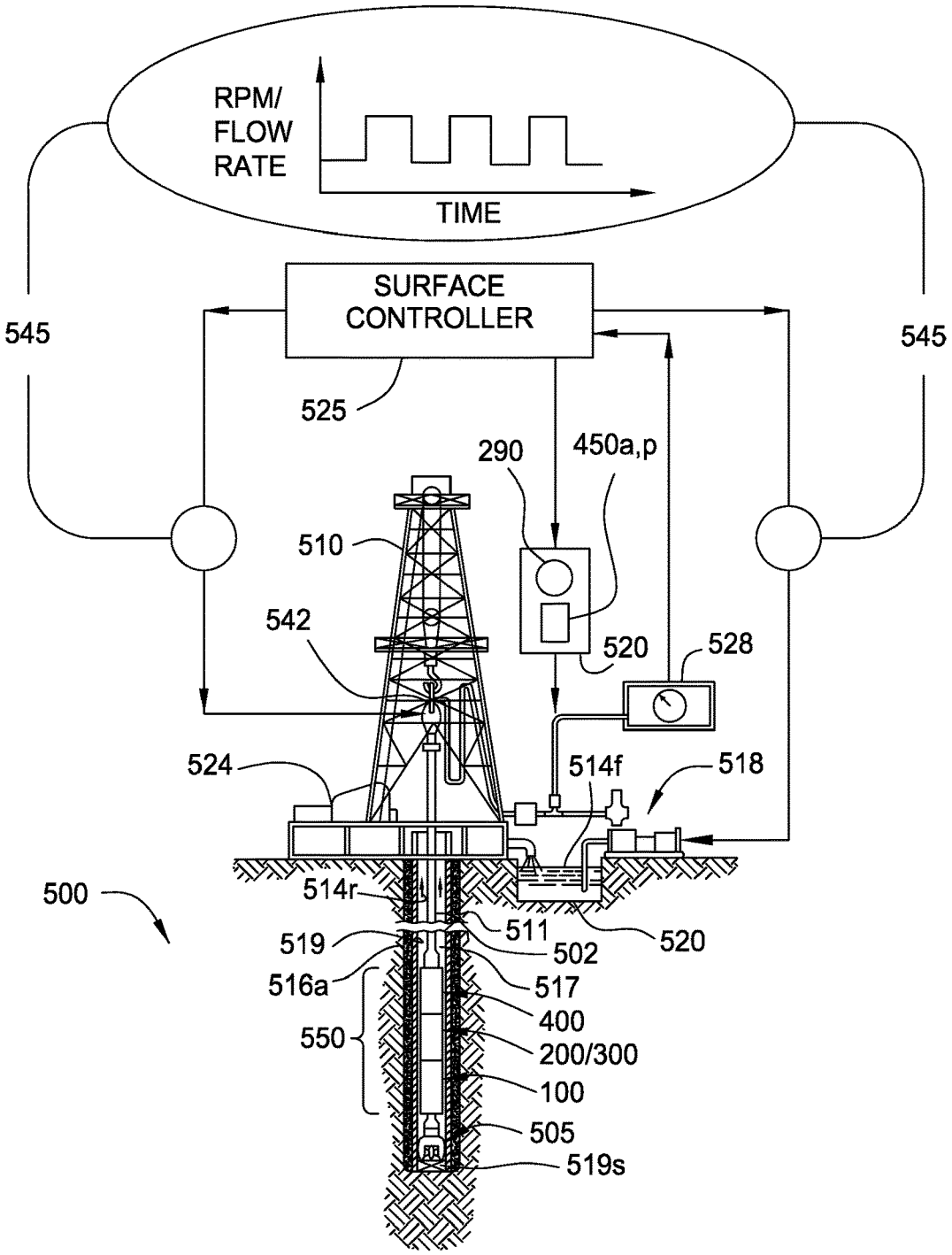
FIGS. 5A and 5B illustrate a drilling system and method utilizing the underreamer, according to another embodiment of the present invention.
Figure 5B:
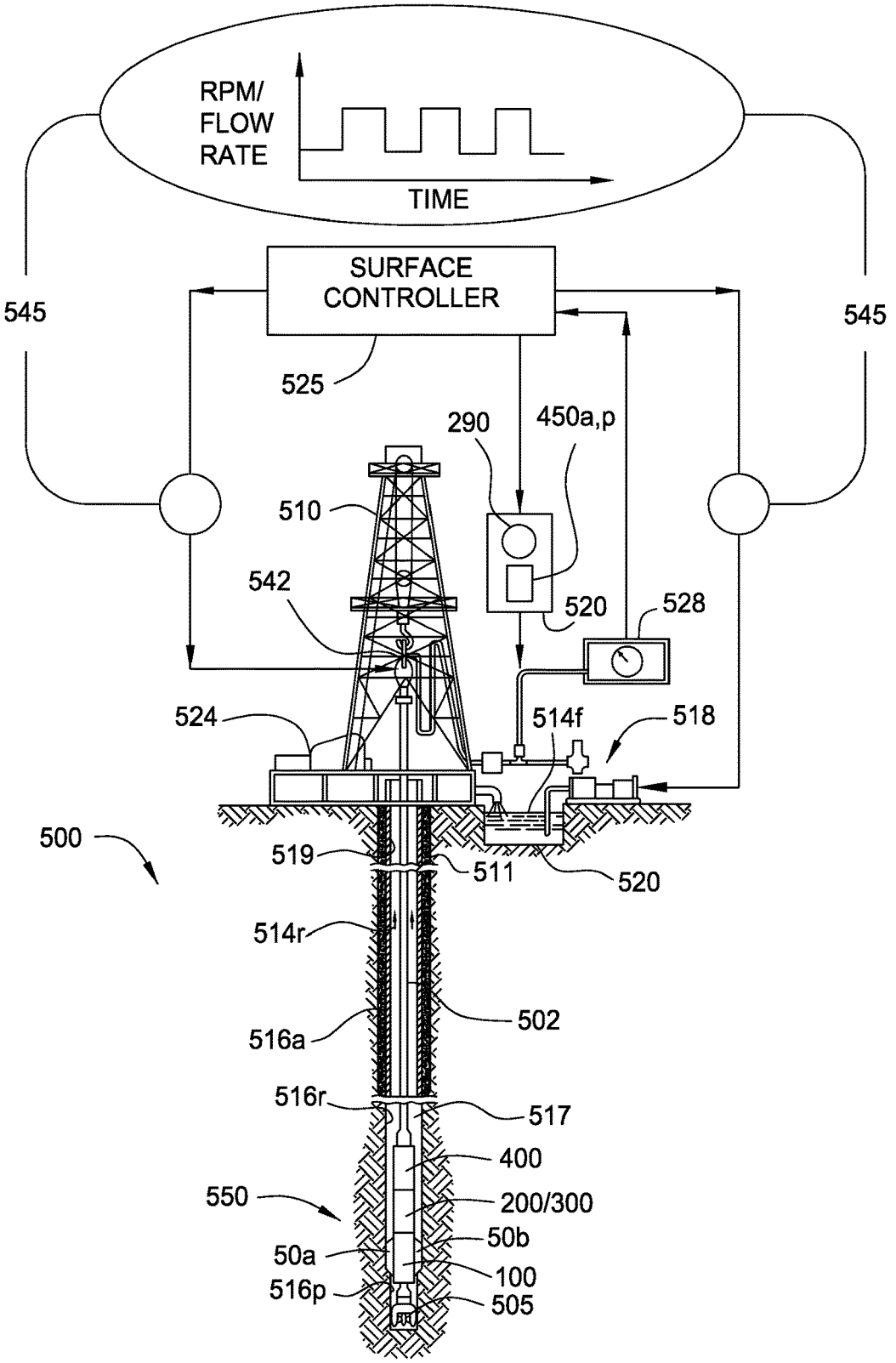

FIGS. 5A and 5B illustrate a drilling system 500 and method utilizing the underreamer 100, according to another embodiment of the present invention.

The drilling system 500 may include a drilling derrick 510. The drilling system 500 may further include drawworks 524 for supporting a top drive 542. The top drive 542 may in turn support and rotate a drilling assembly 500. Alternatively, a Kelly and rotary table (not shown) may be used to rotate the drilling assembly instead of the top drive. The drilling assembly 500 may include a drill string 502 and a bottomhole assembly (BHA) 550. The drill string 502 may include joints of threaded drill pipe connected together or coiled tubing. The BHA 550 may include the telemetry sub 400, the control module 300, the underreamer 100, and a drill bit 505. A rig pump 518 may pump drilling fluid, such as mud 514*f*, out of a pit 520, passing the mud through a stand pipe and Kelly hose to a top drive 542. The mud 514*f* may continue into the drill string, through a bore of the drill string, through a bore of the BHA, and exit the drill bit 505. The mud 514*f* may lubricate the bit and carry cuttings from the bit. The drilling fluid and cuttings, collectively returns 514*r*, flow upward along an annulus 517 formed between the drill string and the wall of the wellbore 516*a*/casing 519, through a solids treatment system (not shown) where the cuttings are separated. The treated drilling fluid may then be discharged to the mud pit for recirculation.

The drilling system may further include a launcher 520, surface controller 525, and a pressure sensor 528. The pressure sensor 528 may detect mud pulses sent from the telemetry sub 400. The surface controller 525 may be in data communication with the rig pump 518, launcher 520, pressure sensor 528, and top drive 542. The rig pump 518 and/or top drive 542 may include a variable speed drive so that the surface controller 525 may modulate 545 a flow rate of the rig pump 518 and/or an angular speed (RPM) of the top drive 542. The modulation 545 may be a square wave, trapezoidal wave, or sinusoidal wave. Alternatively, the controller 545 may modulate the rig pump and/or top drive by simply switching them on and off.

A first section of a wellbore 516*a* has been drilled. A casing string 519 has been installed in the wellbore 516*a* and cemented 511 in place. A casing shoe 519*s* remains in the wellbore. The drilling assembly 500 may then be deployed into the wellbore 516*a* until the drill bit 505 is proximate the casing shoe 519*s*. The drill bit 505 may then be rotated by the top drive and mud injected through the drill string by the rig pump. Weight may be exerted on the drill bit, thereby causing the drill bit to drill through the casing shoe. The underreamer 100 may be restrained in the retracted position by the control module 200/300. Once the casing shoe 519*s* has been drilled through and the underreamer 100 is in a pilot section 516*p* of the wellbore, the underreamer 100 may be extended. If the control module 200 is used, then the surface controller 525 may instruct the launcher 520 to deploy the ball 290. If the control module 300 is used, then the surface controller 525 may instruct the launcher 520 to deploy one of the RFID tags 450*a,p*; modulate angular speed of the top drive 545; or flow rate of the rig pump 518, thereby conveying an instruction signal to extend the underreamer 100. Alternatively, the ball 290/RFID tags 450*a,p* may be manually launched. The telemetry sub 400 may receive the instruction signal; relay the instruction signal to the control module 300 allow the arms 50*a,b* to extend; and send a confirmation signal to the surface via mud pulse. The pressure sensor 528 may receive the mud pulse and communicate the mud pulse to the surface controller. The underreamer 100 may then ream the pilot section 516*p* into a reamed section 516*r*, thereby facilitating installation of a larger diameter casing/liner upon completion of the reamed section.

Alternatively, instead of drilling through the casing shoe, a sidetrack may be drilled or the casing shoe may have been drilled during a previous trip.

Once drilling and reaming are complete, it may be desirable to perform a cleaning operation to clear the wellbore 516*r* of cuttings in preparation for cementing a second string of casing. A second instruction signal may be sent to the telemetry sub 400 commanding retraction of the arms. The rig pump may be shut down, thereby allowing the control module 300 to retract the arms and lock the arms in the retracted position. Once the arms are retracted, the rig pump may resume circulation of drilling fluid and the telemetry sub may confirm retraction of the arms via mud pulse. Once the confirmation is received at the surface, the cleaning operation may commence. The cleaning operation may involve rotation of the drill string at a high angular velocity that may otherwise damage the arms if they are extended. The drilling assembly may be removed from the wellbore during the cleaning operation. Additionally, the control module 300 may be commanded to retract and lock the arms for other wellbore operations, such as underreaming only a selected portion of the wellbore. Alternatively, the drill string may remain in the wellbore during the cleaning operation and then the arms may be re-extended by sending another instruction signal and the wellbore may be back-reamed while removing the drill string from the wellbore. The arms may then be retracted again when reaching the casing shoe. Alternatively, the cleaning operation may be omitted. Alternatively or additionally, the cleaning operation may be occasionally or periodically performed during the drilling and reaming operation.

Alternatively, the drill bit may be rotated at a high speed by a mud motor (not shown) of the BHA and the underreamer 100 may be rotated at a lower speed by the top drive. Since the bit speed may equal the motor speed plus the top drive speed, the mud motor speed may be equal or substantially equal to the top drive speed.

For directional drilling operations, the telemetry sub 400 may be used as an MWD sub for measuring and transmitting orientation data to the surface. Alternatively, the BHA may include a separate MWD sub. The surface may need to send instruction signals to the separate MWD sub in addition to the instruction signals to the telemetry sub. If modulation of the rig pump is the chosen communication media for both MWD and underreamer instruction signals, then the protocol may include an address field or the signals may be multiplexed (e.g., frequency division). Alternatively, modulation of the rig pump may be used to send MWD instructions and top drive modulation may be used to send underreamer instructions. If dynamic steering is employed as discussed in the '100 patent and the underreamer instruction signal is sent by top drive modulation, then the underreamer signal may be multiplexed with the dynamic steering signal. Alternatively, the RFID tag protocol may include an address field distinguishing the instructions.

Alternatively, the underreamer may be used in a drilling with casing/liner operation. The drilling assembly may include the casing/liner string instead of the drill string. The BHA may be operated by rotation of the casing/liner string from the surface of the wellbore or a motor as part of the BHA. After the casing/liner is drilled and set into the wellbore, the BHA may be retrieved from the wellbore. To facilitate retrieval of the BHA, the BHA may be fastened to the casing/liner string employing a latch, such as is disclosed in U.S. Pat. No. 7,360,594, which is herein incorporated by reference in its entirety. Alternatively, the BHA may be drillable. Once the BHA is retrieved, the casing/liner string may then be cemented into the wellbore.

Alternatively, the underreamer may be used in an expandable casing/liner operation. The casing/liner may be expanded after it is run-into the wellbore.

Additionally, a single or multiple underreamers may be used without the pilot bit to ream a casing or liner into a pre-drilled wellbore.

Figure 6A:
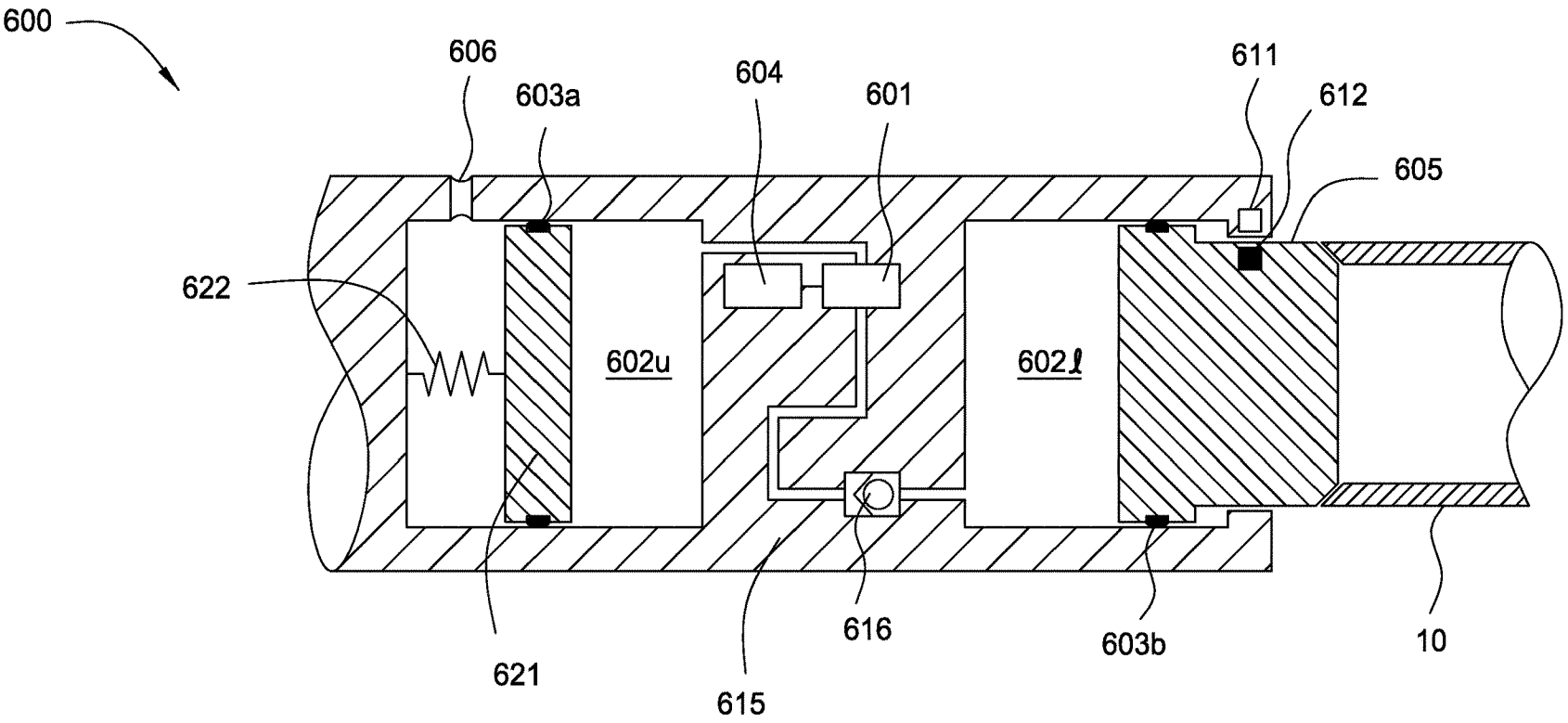
FIG. 6A illustrates an alternative electro-hydraulic control module for use with the underreamer, according to another embodiment of the present invention.

FIG. 6A illustrates a portion of an alternative electro-hydraulic control module 600 for use with the underreamer 100, according to another embodiment of the present invention. The rest of the control module 600 may be similar to the control module 300. The control module 600 may be used instead of the control module 300.

The control module 600 may include an inner body and bulkhead 615. For ease of depiction, the bulkhead and inner body are shown as an integral piece 615. To facilitate manufacture and assembly, the inner body and bulkhead may be made as separate pieces as shown in FIG. 3. The control module 600 may further include upper 602*u* and lower 602*l* hydraulic chambers having hydraulic fluid disposed therein and isolated by seals 603*a,b*. The control module 600 may further include an actuator so that the control module 600 may actively move the underreamer piston 10 while the rig pump 518 is injecting drilling fluid through the control module 600 and the underreamer 100. The actuator may be a hydraulic pump 601 in communication with the upper 602*u* and lower 602*l* hydraulic chambers via a hydraulic passage and operable to pump the hydraulic fluid from the upper chamber 602*u* to the lower chamber 602*l* while being opposed by the underreamer piston 10. Alternatively, the pump may be a hydraulic amplifier on a lead or ball screw being turned by the electric motor. Additionally, as with the control module 300, the control module 600 may further include a second passage (not shown) with a pressure sensor for detecting engagement of the underreamer piston with the position sensor.

The electric motor 604 may drive the hydraulic pump 601. The electric motor 604 may be reversible to cause the hydraulic pump 601 to pump fluid from the lower chamber 602*l* to the upper chamber 602*u*. The active control module 600 may receive an instruction signal from the surface (as discussed above via the telemetry sub 400) and operate the underreamer 100 without having to wait for shut down of the rig pump 518. Alternatively, the underreamer piston force may be reduced by decreasing flow rate of the drilling fluid or shutting off the rig pump before or during sending of the instruction signal.

The control module 600 may further include a solenoid valve, such as a check valve 616 or shutoff valve, operable to prevent flow from the lower chamber to the upper chamber in the closed position. Similar to the control module 300, the position piston 605 may prevent the underreamer piston 10 from extending the arms 50*a,b* while drilling fluid 514*f* is pumped through the control module 600 and the underreamer 100 due to the closed check valve 616. The control module 600 may further include a position sensor, such as a Hall sensor 611 and magnet 612, which may be monitored by the controller 325 to allow extension of the arms to one or more intermediate positions and/or to confirm full extension of the arms. Alternatively, the position sensor may be a linear voltage differential transformer (LVDT). The control module 600 may further include a compensating piston 621 to equalize pressure between drilling fluid (via port 606) and the upper chamber 602*u*. The control module may further include a biasing member, such as a spring 622, to bias flow of hydraulic fluid from the upper 602*u* to the lower 602*l* chamber.

In operation, when the controller 325 receives a signal instructing extension of the arms 50*a,b*, the controller 325 may open the solenoid check valve 616 so oil may flow through the hydraulic passage from the lower chamber to the upper chamber. Depending on whether the rig pump is operating, the controller 325 may then supply electricity to the motor 604, thereby driving the pump 601. If the rig pump is operating, the underreamer piston 10 may force hydraulic fluid through the pump 601, thereby obviating the need to operate the motor and the pump. The hydraulic pump 601 may then transfer oil from the lower reservoir to the upper reservoir to retract the position piston 605. If the rig pump is shut down, the underreamer piston may not follow the position piston until the rig pump is operated. Once the controller 325 detects that the position piston 605 is in the instructed position via the position sensor 611, 612, the controller may shut off the motor and pump and close the solenoid check valve.

In operation, when the controller 325 may receive a signal instructing retraction of the arms 50*a,b*, the controller 325 may open the solenoid check valve 616 so oil may flow through the hydraulic passage from the upper chamber to the lower chamber or operation of the pump may open the valve.

The controller 325 may then supply electricity to the motor 604, thereby driving the pump 601. The hydraulic pump 601 may then transfer oil from the upper reservoir to the lower reservoir to extend the position piston 605. Once the controller 325 detects that the position piston 605 is in the instructed position via the position sensor 611, 612, the controller may shut off the motor and pump and close the solenoid check valve. If the controller 325 does not detect that the position piston has moved to the instructed position after a predetermined period of time, the controller 325 may shut off the motor and close the valve and send an error message to the surface (via the telemetry sub). Alternatively, the controller 325 may periodically retry to move the position piston or wait for shut-down of the rig pump and then re-try.

Figure 6B:
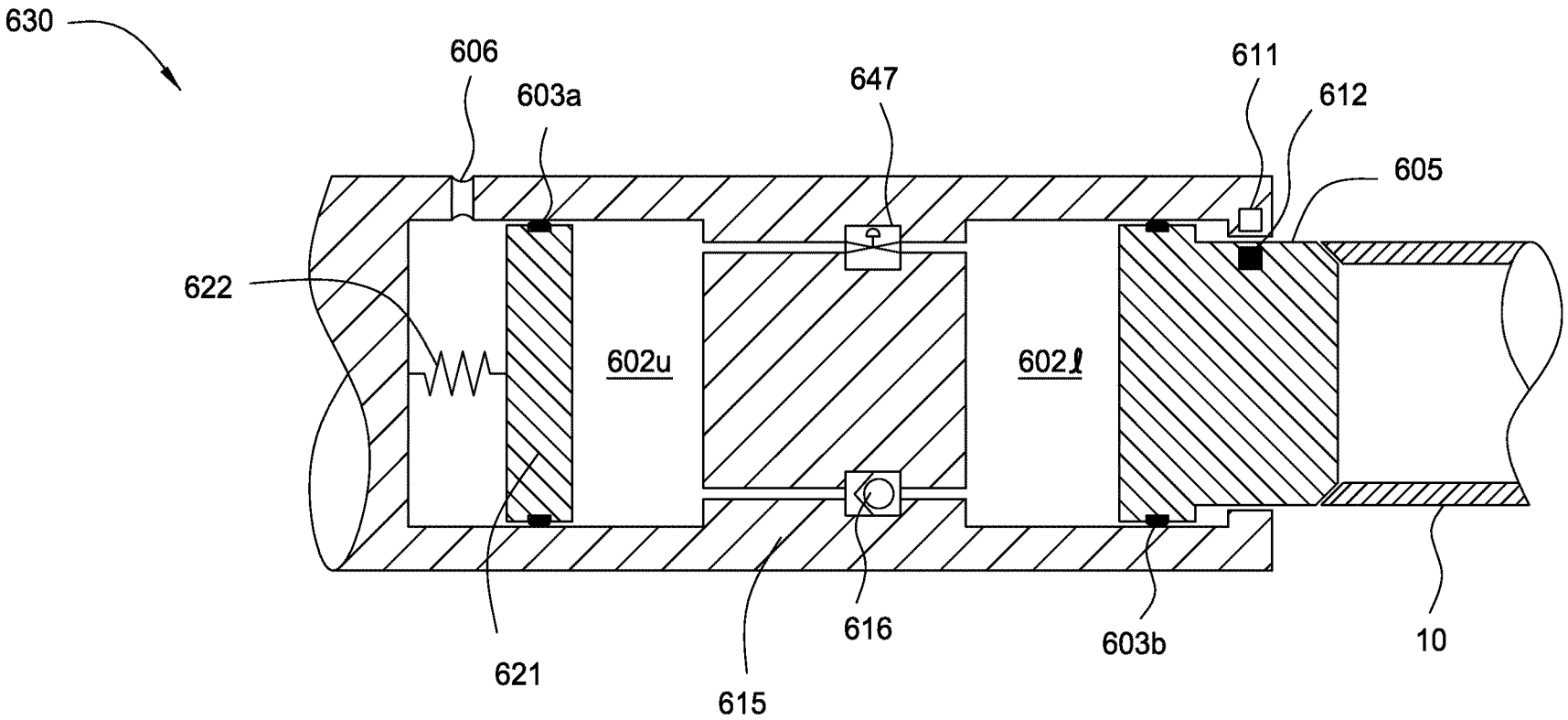
FIG. 6B illustrates another alternative electro-hydraulic control module for use with the underreamer, according to another embodiment of the present invention.

FIG. 6B illustrates a portion of an alternative electro-hydraulic control module 630 for use with the underreamer 100, according to another embodiment of the present invention. The rest of the control module 630 may be similar to the control module 300. The control module 630 may be used instead of the control module 300.

The control module 630 may include an inner body and bulkhead 615. For ease of depiction, the bulkhead and inner body are shown as an integral piece 615. To facilitate manufacture and assembly, the inner body and bulkhead may be made as separate pieces as shown in FIG. 3. The control module 630 may further include upper 602*u*and lower 602*l* hydraulic chambers having hydraulic fluid disposed therein and isolated by seals 603*a,b*. The control module 630 may further include an actuator, such as a solenoid operated shutoff valve 647, in communication with the upper 602*u*and lower 602*l*hydraulic chambers via a first hydraulic passage. A check valve 646 may be disposed in a second hydraulic passage in communication with the hydraulic chambers 602*u,l*. The check valve 646 may be oriented to allow fluid flow from the lower chamber 602*l*to the upper chamber 602*u*and prevent fluid flow from the upper chamber to the lower chamber. The shutoff valve 647 may normally be in a closed position until operated by the controller 325. Additionally, as with the control module 300, the control module 600 may further include a third passage (not shown) with a pressure sensor for detecting engagement of the underreamer piston with the position sensor.

Similar to the control module 300, the position piston 605 may prevent the underreamer piston 10 from extending the arms 50*a,b* while drilling fluid 514*f* is pumped through the control module 630 and the underreamer 100 due to the closed check valve 616. The control module 630 may further include a position sensor, such as a Hall sensor 611 and magnet 612, which may be monitored by the controller 325 to allow extension of the arms to one or more intermediate positions and/or to confirm full extension of the arms. Alternatively, the position sensor may be a linear voltage differential transformer (LVDT). The control module 630 may further include a compensating piston 621 to equalize pressure between drilling fluid (via port 606) and the upper chamber 602*u*. The control module may further include a biasing member, such as a spring 622, to bias flow of hydraulic fluid from the upper 602*u* to the lower 602*l* chamber and bias the arms 50*a,b* toward the retracted position. Alternatively, the motor 604 and pump 601 may be installed in the first passage instead of or in addition to the shutoff valve 647.

In operation, when the controller 325 receives a signal instructing extension of the arms 50*a,b*, the controller 325 may open the shutoff valve 647 so oil may flow through the first hydraulic passage from the lower chamber to the upper chamber and hold the shutoff valve open while the underreamer is in use to ensure firm engagement of the blades 50*a,b* with the body 5. The holding and opening currents may be different. The controller 325 may occasionally reapply the opening current to ensure that shock or vibration has not caused closure of the shutoff valve 647. Alternatively, as discussed below, if the control module 630 is deployed with an adjustable underreamer or adjustable stabilizer, the controller may close the shutoff valve 647 once the controller detects that the piston 605 is in the instructed position.

In operation, when the controller 325 receives a signal instructing retraction of the arms 50*a,b*, the controller 325 may open the shutoff valve 647 so oil may flow through the hydraulic passage from the upper chamber to the lower chamber (once the rig pump is shut off). The controller may then close the shutoff valve after a predetermined period of time or upon detection of movement of the piston 605 to the retracted position. If the arms 50*a,b* are not fully retracted when the shutoff valve is closed, the check valve 646 may allow the spring 622 to complete retraction of the arms.

Figure 6C:
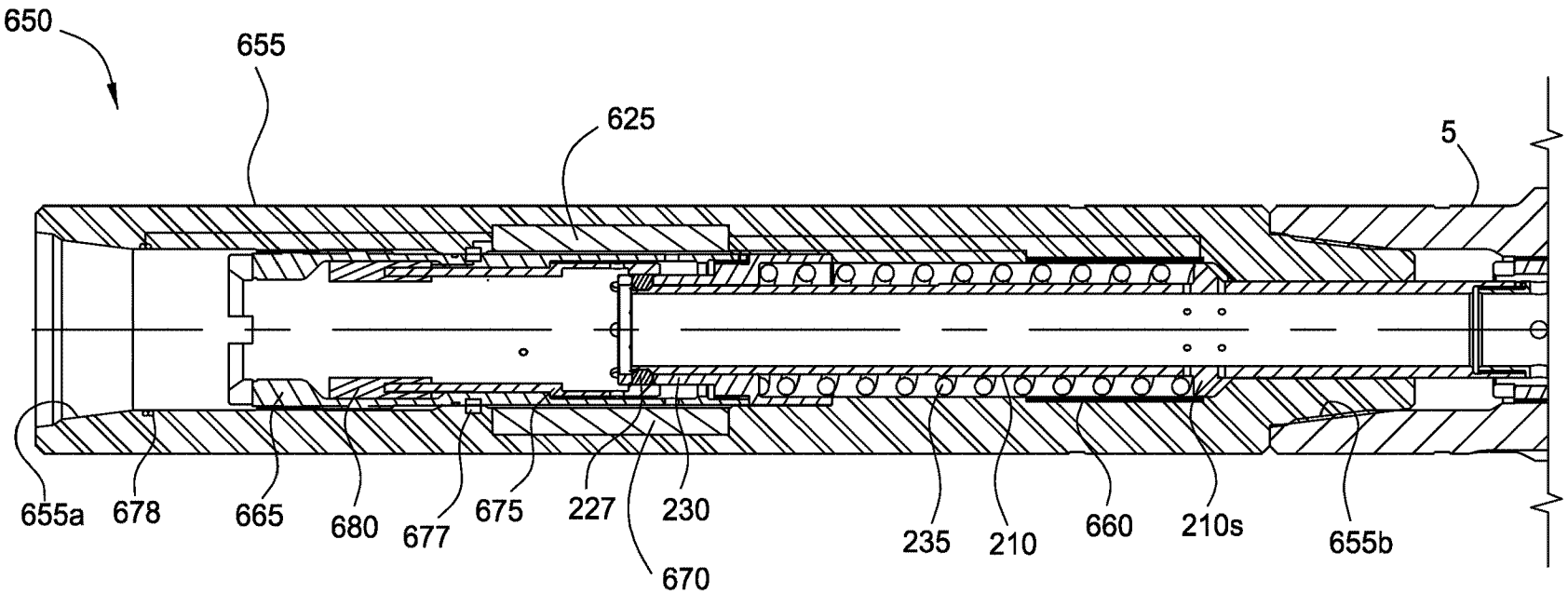
FIG. 6C illustrates an alternative electro-mechanical control module for use with the underreamer, according to another embodiment of the present invention.

FIG. 6C illustrates an alternative electro-mechanical control module 650 for use with the underreamer 100, according to another embodiment of the present invention.

The control module 650 may include a body 655, the control mandrel 210, an actuator housing 665, a keeper 675, the lock mandrel 230, an electronics package 625, the biasing member 235, a battery 670, and a linear actuator 680. The body 655 may be tubular and have a longitudinal bore formed therethrough. Each longitudinal end 655*a,b* of the body 655 may be threaded for longitudinal and rotational coupling to other members, such as the underreamer 100 at 655*b* and the telemetry sub 400 at 655*a*. The electronics package 625 may include a controller, such as a microprocessor, a power regulator, and a modem. A data connector, such as an inductive coupling 678, may be disposed at or near upper end 655*a* for interfacing with an inductive coupling disposed at or near a lower end of the telemetry sub 400, thereby providing data communication between the controller 430 and the controller 625. Alternatively, the data connector may be hard-wire or short-hop antenna. The controller 625 may be in electrical communication with the inductive coupling 678, position sensor 660, and power coupling 677 via leads. The power coupling 677 may be in electrical communication with the linear actuator 680 via leads. The linear actuator 680 may be a linear motor or a rotary motor and a lead screw or a ball screw. The linear actuator 680 may also include a position sensor for monitoring the position of the keeper 675 and may communicate with the controller 625 via the power coupling 677 or a separate data coupling (not shown).

In operation, the control module 650 may operate similar to the control module 200 except that instead of dropping the ball 290 to operate the piston 220, the controller 625 may operate the linear actuator 680 to move the keeper 675, thereby releasing the dogs 227. The controller 625 may receive the instruction signal from the telemetry sub 400 via the inductive coupling 678. The controller 625 may also monitor a position of the control mandrel shoulder 210*s* using position sensor 660 in order to report successful deployment of the arms 50*a,b*. After completion of the drilling/reaming operation, the controller 625 may receive a signal instructing retraction of the arms 50*a,b* from the telemetry sub 400. The controller 625 may wait for detection of movement of the control mandrel to the retracted position by the spring 235. The controller 625 may then reverse the linear actuator 680, thereby re-locking the dogs 227 against the control mandrel. The controller 625 may then report successful retraction and re-locking of the arms to the surface or an error message if either retraction or re-locking is not successful Alternatively, the dogs 227 may be replaced by a collet fingers (not shown) formed on an end of the lock mandrel 230 and a corresponding profile may be formed in the end of the control mandrel 210. The keeper 675 may then engage the collet fingers and prevent the fingers from expanding until moved by the linear actuator 680. Alternatively, locking pins may be used instead of the dogs and an electromagnet may be used instead of the linear actuator.

Alternatively, instead of replacing the piston 220 with the linear actuator, the actuator may instead be arranged to move the piston 220 without obstructing the ball seat 220*s* so that the piston may be moved using either the actuator or the ball 290, thereby providing redundancy.

Alternatively, instead of modifying the mechanical control module 200, an electromechanical adapter (not shown) may be connected to the mechanical control module 200 by a threaded connection. The adapter may include the electronics package and an actuator for engaging the ball seat and breaking the shear screws 222. The actuator may include a plunger which may engage or abut the ball seat. Alternatively the adapter may break or remove the shear screw.

Alternatively, the actuator 680, electronics package 680, and battery 670 may be omitted and the keeper 675 may be modified to have a latch profile (not shown) formed in an inner surface thereof and a detent disposed in an outer surface thereof. The actuator housing 665 may be modified to have detent profiles formed on an inner surface thereof corresponding to positions where the keeper is engaged with the dogs 227 and disengaged from the dogs 227, respectively. An actuator having a latch may then be deployed from the surface using wireline to engage the latch profile. The keeper 675 may then be moved from one of the engaged and disengaged positions to the other position using the actuator. The latch may then be released by sending a signal to the actuator via the wireline. The wireline and actuator may be retrieved to the surface and re-deployed when it is desired to move the keeper 675. Alternatively, the actuator may be deployed using slickline by including a battery and a controller. Additionally if the arms 50*a,b* are jammed in the extended position, the actuator may engage the control mandrel 210 and weight of the actuator may be set on the control mandrel to push the blades toward the retracted position.

Figure 7A:
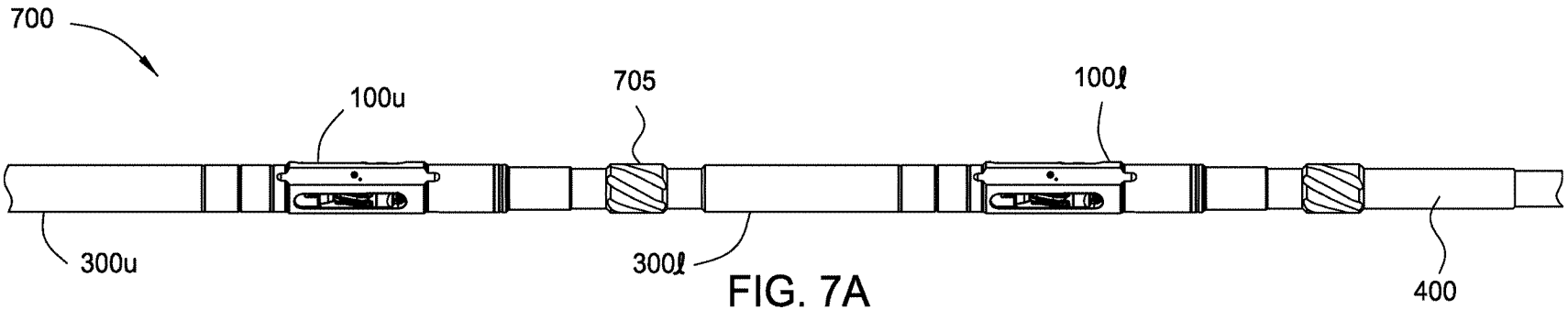
FIG. 7A illustrates a bottom hole assembly (BHA) including dual underreamers, according to another embodiment of the present invention.
Figure 7B:
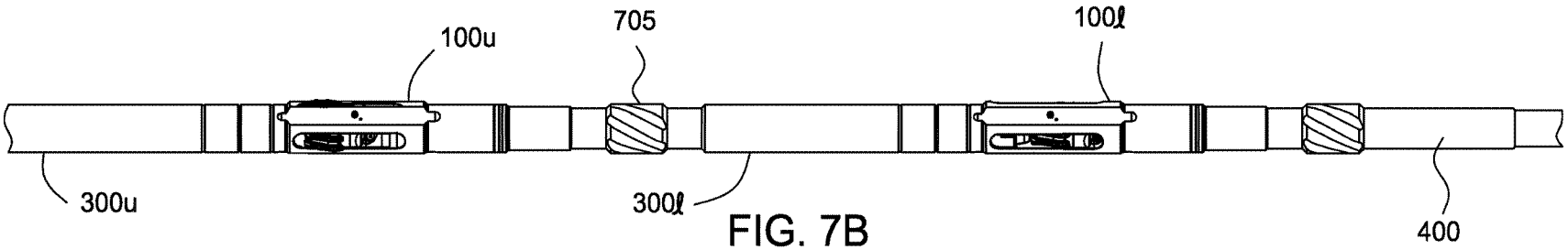
FIGS. 7B and 7C illustrates an operating sequence for the dual underreamers.
Figure 7C:
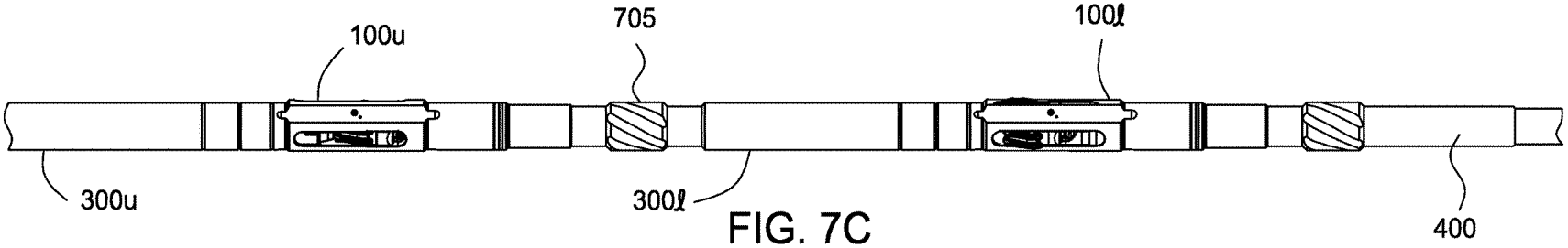

FIG. 7A illustrates an alternate BHA 700 including dual underreamers 100*u,l*, according to another embodiment of the present invention. FIGS. 7B and 7C illustrates an operating sequence for the dual underreamers 100*u,l*. The BHA 700 may be used instead of the BHA 550. The BHA 700 may include an upper control module 300*u*, an upper underreamer 100*u*, one or more stabilizers 705, a lower control module 300*l*, a lower underreamer 300*l*, and the telemetry sub 400, and a drill bit (not shown, see 505). Alternatively, the control module 600 or control module 650 may replace the control modules 300*u,l*.

In operation, the BHA 700 is deployed into the wellbore and, if necessary, the casing shoe is drilled with both underreamers 100*u,l* locked in the retracted position. Once the shoe is drilled through and the BHA is in the pilot section clear of the casing, an instruction signal may be sent to the telemetry sub 400 commanding extension of the upper underreamer 100*u*. The telemetry sub 400 may then relay the signal to the upper control module 300*u*. The upper control module 300*u* may then release the upper underreamer as discussed above. The wellbore may then be drilled and reamed until the upper underreamer becomes dull. An instruction signal may then be sent to the telemetry sub 400 commanding retraction of the upper underreamer 100*u* and extension of the lower underreamer without tripping the drill string from the wellbore. The wellbore may then be drilled and reamed until the section is finished. As discussed above, the wellbore may then be cleaned and/or back reamed and the drilling assembly removed from the wellbore.

Additionally, a third underreamer and control module may be added if necessary. The third underreamer may be placed adjacent the bit. The third underreamer may be activated at total depth (TD) to eliminate the rat hole. Additionally, the BHA may include four or more underreamers and control modules.

Alternatively, the operating sequence may be reversed. Alternatively, both underreamers may be opened together. When the lower underreamer becomes dull, the lower underreamer may be closed and drilling may continue with only the upper underreamer. Alternatively the lower underreamer arms may have a smaller outer diameter in the extended position and the upper underreamer may have a greater diameter in the extended position and both underreamers may be opened together, thereby creating a two-stage reamer. The two-stage reaming may lessen the wear on both underreamers.

Alternatively, the mechanical control module 200 may be used instead of the upper electro-hydraulic control module 300*u*. Both underreamers may be locked in the retracted position upon deployment through the casing and drill-through of the casing shoe. The ball 290 may then be launched and the upper underreamer extended. Once the upper underreamer arms become dull, an instruction signal may be sent to the telemetry sub and relayed to the lower control module, thereby extending the lower underreamer arms. Drilling and reaming may then re-commence. The drill string may be raised before extension of the lower underreamer so that the lower underreamer is in the section reamed by the upper underreamer, thereby maintaining hole size. The upper underreamer nozzles may include a screen, such as a sand screen, for preventing the RFID tag from being discharged therethrough. The upper underreamer may be left in the extended position and used as a stabilizer. Alternatively, the operating sequence may be reversed. Extending the lower underreamer arms first may negate the need for a screen since the upper nozzles would be closed by the mandrel 20. Further, reversing the order negates the need for lifting the drill string before re-commencing drilling. Further, reversing the order and activating the lower underreamer first reduces or eliminates the risk that the lower electro-hydraulic control module will become damaged during drilling prior to the desired actuation of the lower underreamer.

Alternatively, the mechanical control module 200 may be used instead of the lower electro-hydraulic control module 300*l* and the electro-mechanical control module 650 may be used instead of the upper electro-hydraulic control module 300*u*. Both underreamers may be locked in the retracted position upon deployment through the casing and drill-through of the casing shoe. An instruction signal may be sent to the telemetry sub and relayed to the upper control module, thereby extending the upper underreamer arms. Drilling and reaming may then commence. Once the upper underreamer becomes dull, the ball may then be launched and the lower underreamer arms extended. The upper underreamer may be left in the extended position and used as a stabilizer or it may be retracted.

Alternatively, each of the control modules 300*u,l* may be replaced by the mechanical control module 200 and the telemetry sub 400 may be omitted. The wellbore may then be drilled with the upper underreamer first. The upper control module may be modified with a hinged expandable or frangible ball seat set at a pressure greater than the shear screws 222. When the upper underreamer becomes dull, then the pressure may be increased to fracture the hinged ball seat, thereby dropping the ball to the lower control module ball seat. The lower control module may then be activated. The upper control module may remain extended and serve as a stabilizer. Alternatively, the upper control module may have a larger ball seat than the lower control module. The lower control module may be activated first with a smaller ball which may pass through the larger upper seat. A larger ball may then be dropped to activate the upper control module.

Alternatively, the cutters 55 may be omitted from the upper underreamer 100*u* and the upper underreamer 100*u* may be extended simultaneously with or shortly after the lower underreamer 100*l* and used as a stabilizer. Alternatively, a third underreamer without cutters and a third control module may be added to the BHA 700 above the upper control module 300*u* and used as a stabilizer. Alternatively, the section mill 1100 without cutters may replace the upper underreamer and control module and be extended and used as an adjustable stabilizer or added to the BHA 700 above the upper control module 300*u*. In the adjustable stabilizer alternatives, the instruction signal may include an extension setting for the adjustable stabilizer. The adjustable stabilizer arms may be extended to a diameter substantially equal to the extended lower underreamer arms.

Alternatively, the adjustable stabilizer may be used to steer the drill bit in a directional drilling operation. In a directional drilling operation, the lower underreamer 100*l* may act as a fulcrum or pivot point for the bit due to the weight of the drill collars behind the lower underreamer 100*l* forcing the lower underreamer 100*l* to push against the lower side of the borehole. Accordingly, the drill bit tends to be lifted upwardly at an angle, e.g. build angle. Selective extension of the adjustable stabilizer may control this effect. Namely, as the drill bit builds angle due to the fulcrum effect created by the lower underreamer 100*l*, the adjustable stabilizer engages the lower side of the borehole, thereby causing the longitudinal axis of the bit to pivot downwardly so as to drop angle. A radial change of the adjustable stabilizer arms may control the pivoting of the bit on the lower underreamer 100*l*, thereby providing a two-dimensional, gravity based steerable system to control the build or drop angle of the drilled borehole as desired.

Figure 8:
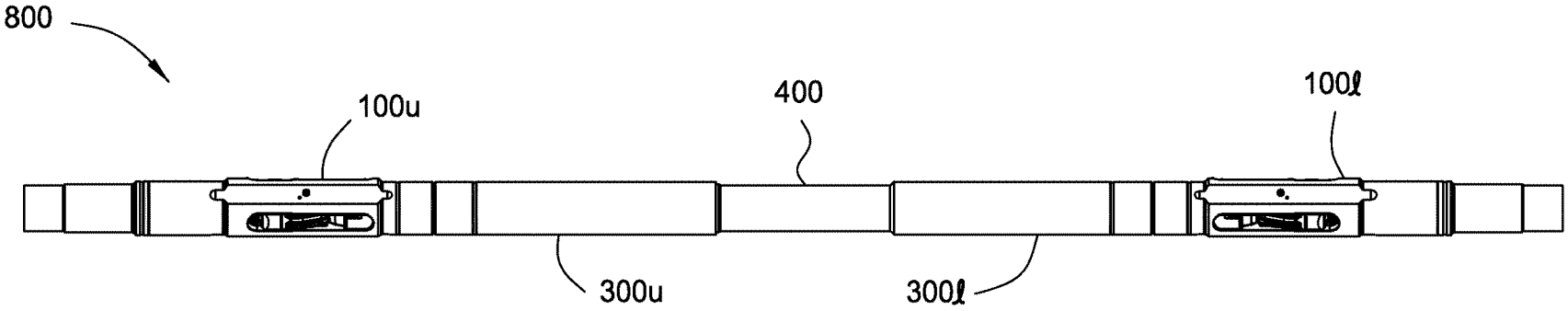
FIG. 8 illustrates an alternative dual underreamer BHA, according to another embodiment of the present invention.

FIG. 8 illustrates an alternative dual underreamer BHA 800, according to another embodiment of the present invention. The BHA 800 may include an upper control module 300*u*, an upper underreamer 100*u*, one or more stabilizers 705, a lower control module 300*l*, a lower underreamer 300*l*, and the telemetry sub 400, and a drill bit (not shown, see 505). Alternatively, the control module 600 or control module 650 may replace the control modules 300*u,l*. The upper underreamer 100*u* and control module 300*u* may be flipped upside down so that the control modules and the telemetry sub may be placed adjacent one another. This arrangement may facilitate hard-wiring or inductive couplings to be used to transfer data between the control modules and the telemetry sub.

Alternatively, this arrangement may facilitate integration of the control module and telemetry sub electronics and even structural integration so that one sub having one battery and one controller may perform the function of the control modules and the telemetry sub.

Figure 9:
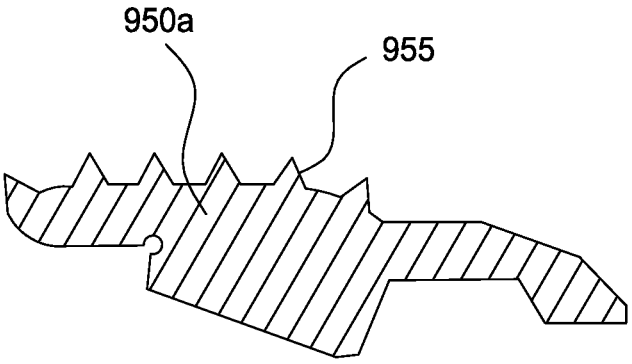
FIG. 9 illustrates an underreamer arm configured for soft formations, according to another embodiment of the present invention.

FIG. 9 illustrates an underreamer arm 950*a* configured for soft formations, according to another embodiment of the present invention. Instead of super-hard cutters, the arm 955 may have teeth formed on one or more blades thereof, such as by casting, milling, or machining. Alternatively, cutters made from a hard or superhard material may be disposed along each of the blades, as discussed above. The cutters may be substantially larger than the cutters 55 and spaced substantially further apart than the cutters 55. Alternatively, the teeth may be hard-faced. The arms 50*a,b* of either of the underreamers 100*u,l* may be replaced by the arm 950*a* so that one of the underreamers is configured to ream a hard formation, such as limestone, and the other is configured to ream a soft formation, such as shale. The soft-arm underreamer may then be extended for reaming the soft formation while the hard-arm underreamer is retracted and the hard-arm underreamer may be extended for reaming a hard formation while the soft-arm underreamer is retracted. Alternatively, one of the upper underreamer and lower underreamer may have arms configured to forward ream and the other of the upper and lower underreamer may have arms configured to back ream and the forward arm underreamer may be extended while forward reaming while the back ream underreamer is retracted and vice versa. Alternatively, the BHA may include an underreamer and a casing cutter or section mill (discussed below).

Alternatively, the arms of a first of the underreamers 100*u,l* may be configured to ream a first geological formation and the arms of a second of the underreamers 100*u,l* may be configured to ream a second geological formation. In operation, the arms of the first underreamer may be extended and the first formation drilled and reamed until the second formation is encountered. The arms of the second underreamer may then be extended and the arms of the first underreamer may be optionally retracted. The second formation may then be drilled and reamed. Optionally, the arms of the first underreamer may then be extended if a new geological formation is encountered.

Figure 10A:
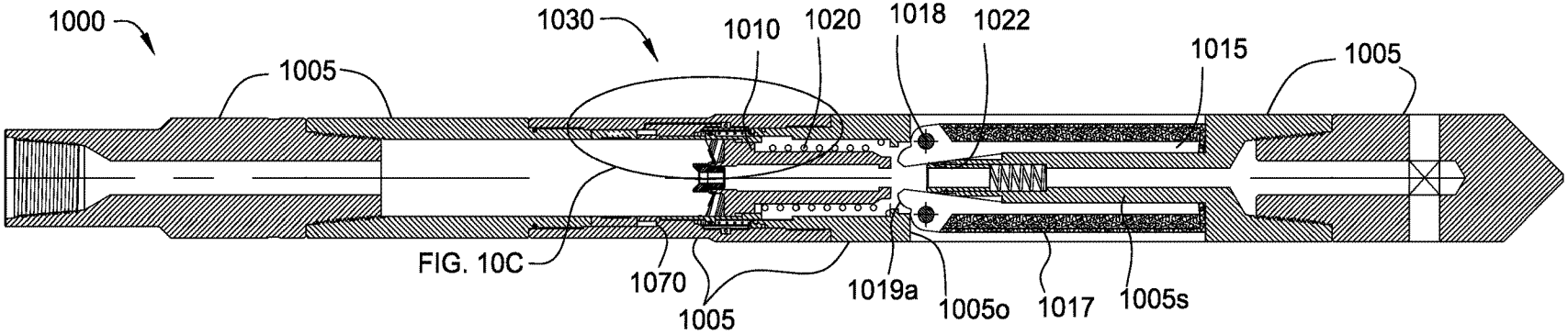
FIG. 10A is a cross section of a casing cutter in a retracted position, according to another embodiment of the present invention.
Figure 10B:
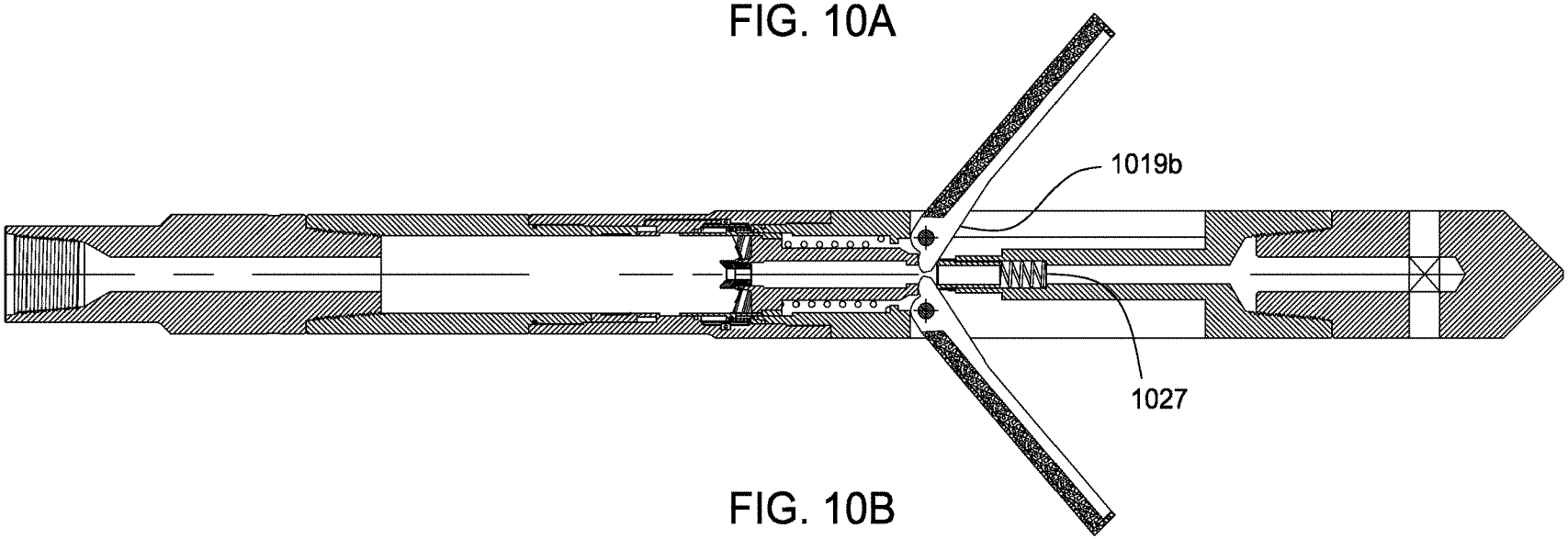
FIG. 10B is a cross section of the casing cutter in an extended position.
Figure 10C:
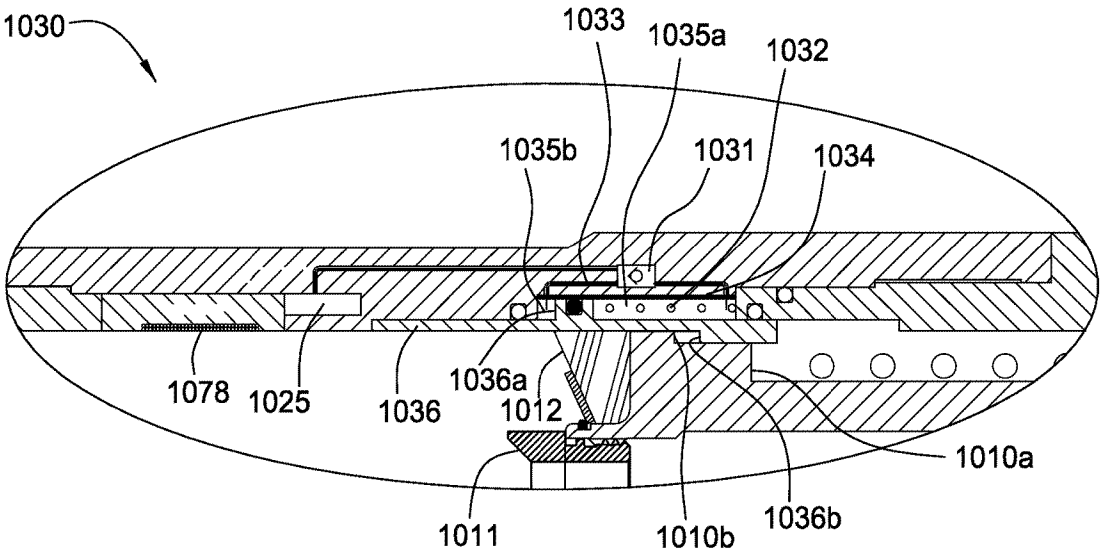
FIG. 10C is an enlargement of a portion of FIG. 10A.

FIG. 10A is a cross section of a casing cutter 1000 in a retracted position, according to another embodiment of the present invention. FIG. 10B is a cross section of the casing cutter 1000 in an extended position. FIG. 10C is an enlargement of a portion of FIG. 10A. The casing cutter 1000 may include a housing 1005, a plurality of arms 1015, a piston 1010, a seal 1012, a piston spring 1020, a follower 1022, a follower spring 1027, and a control module 1030. The control module 1030 may include an electronics package 1025, a solenoid valve 1031, a stop spring 1032, a flow passage 1033, a position sensor 1034, chambers 1035*a,b*, and a sleeve 1036, a battery 1170, and an antenna 1178. The electronics package 1025 may include a controller, such as microprocessor, power regulator, and transceiver.

The housing 1005 may be tubular and may have a threaded coupling formed at a longitudinal end thereof for connection to a workstring (not shown) deployed in a wellbore for an abandonment operation. The workstring may be drill pipe or coiled tubing. To facilitate manufacture and assembly, the housing 1005 may include a plurality of longitudinal sections, each section longitudinally and rotationally coupled, such as by threaded connections, and sealed (above the piston 1010), such as by o-rings. Each arm 1015 may be pivoted 1018 to the housing for rotation relative to the housing between a retracted position and an extended position. A coating 1017 of hard material, such as tungsten carbide ceramic or cermet, may be bonded to an outer surface and a bottom of each arm 1016. The hard material 1017 may be coated as grit. An upper surface of each arm 1015 may form a cam 1019*a* and an inner surface of each arm may form a taper 1019*b*. The housing 1005 may have an opening 1005*o* formed therethrough for each arm 1015. Each arm 1015 may extend through a respective opening 1005*o* in the extended position.

The piston 1010 may be tubular, disposed in a bore of the housing 1005, and include a main shoulder 1010*a*. The piston spring 1020 may be disposed between the main shoulder 1010*a* and a shoulder formed in an inner surface of the housing, thereby longitudinally biasing the piston 1010 away from the arms 1015. A nozzle 1011 may be longitudinally coupled to the piston 1010, such as by a threaded connection, and made from an erosion resistant material, such as a metal, alloy, or cermet. To extend the arms 1015, drilling fluid may be pumped through the workstring to the housing bore. The drilling fluid may then continue through the nozzle 1011. Flow restriction through the nozzle 1011 may cause pressure loss so that a greater pressure is exerted on a top of the piston 1010 than on the main shoulder 1010*a*, thereby longitudinally moving the piston downward toward the arms and against the piston spring 1020. As the piston 1010 moves downward, a bottom of the piston 1010 may engage the cam surface 1019*a* of each arm 1015, thereby rotating the arms 1015 about the pivot 1018 to the extended position.

The housing 1005 may have a stem 1005*s* extending between the arms 1015. The follower 1022 may extend into a bore of the stem 1005*s*. The follower spring 1027 may be disposed between a bottom of the follower and a shoulder of the stem 1005*s*. The follower 1022 may include a profiled top mating with each arm taper 1019*b* so that longitudinal movement of the follower toward the arms 1015 radially moves the arms toward the retracted position and vice versa. The follower spring 1027 may longitudinally bias the follower 1022 toward the arms 1015, thereby also biasing the arms toward the retracted position. When flow through the housing 1005 is halted, the piston spring 1020 may move the piston 1010 upward away from the arms 1015 and the follower spring 1027 may push the follower 1022 along the taper 1019*b*, thereby retracting the arms.

The chambers 1035*a,b* may be filled with a hydraulic fluid, such as oil. The first chamber 1035*a* may be formed radially between an inner surface of the housing 1005 and an outer surface of the sleeve 1036 and longitudinally between a bottom of a first shoulder 1036*a* of the sleeve and a top of one of the housing sections. The second chamber 1035*b* may be formed radially between an inner surface of the housing 1005 and an outer surface of the sleeve 1036 and longitudinally between a top of the first shoulder 1036*a* and a shoulder of the housing. The position sensor 1034 may measure a position of the first shoulder 1036*a* and communicate the position to the controller 1025. The solenoid operated valve 1031 may be a check valve operable between a closed position where the valve functions as a check valve oriented to prevent flow from the first chamber to the second chamber (downward flow) and allow reverse flow therethrough, thereby fluidly stopping downward movement of the sleeve 1036. The sleeve 1036 may further include a second shoulder 1036*b* and the piston may include a stop shoulder 1010*b*. Engagement of the stop shoulder 1010*b* with the second shoulder 1036*b* may also stop downward movement of the piston, thereby limiting extension of the arms 1015.

In operation, when it is desired to activate the cutter 1000, an instruction signal may be sent to the telemetry sub 400 and relayed to the controller 1025 via the antenna 1078, thereby conveying an arm setting command. Drilling fluid may then be circulated through the workstring from the surface to extend the arms 1015. The microprocessor 1025 may monitor the position of the sleeve 1036 until the sleeve reaches a position corresponding to the set position of the arms 1015. The microprocessor 1025 may then supply electricity from the battery 1070 to the solenoid valve 1031, thereby closing the solenoid valve and halting downward movement of the sleeve 1036 and extension of the arms 1015. The workstring may then be rotated, cutting through a wall of a casing string to be removed from the wellbore. Once the casing string has been cut, the casing cutter 1000 may be redeployed in the same trip to cut a second casing string having a different diameter by sending a second instruction signal.

Additionally, the control module may lock the arms in the retracted position to prevent premature actuation of the arms. Alternatively, the first arm setting may be preprogrammed at the surface.

Figure 10D:
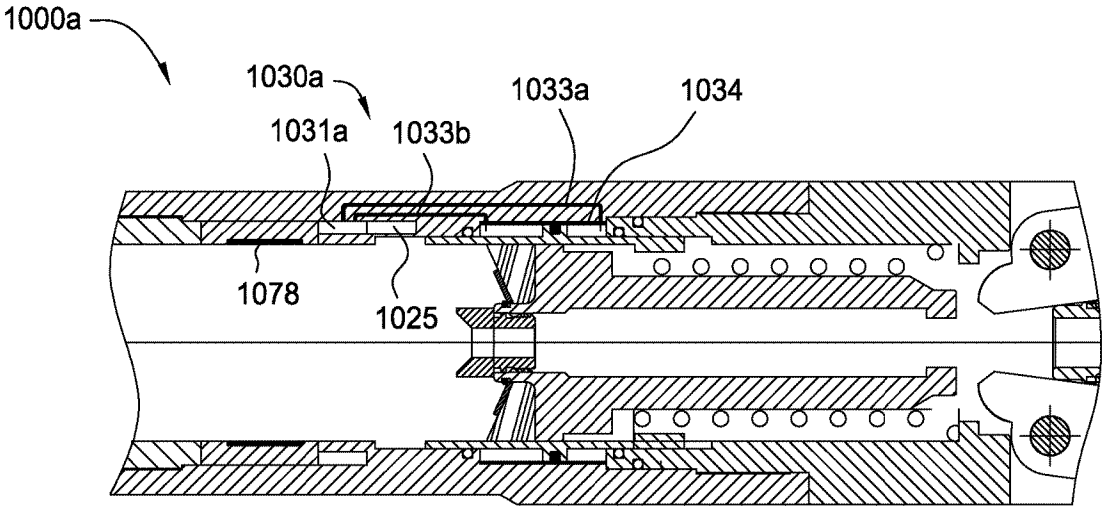
FIG. 10D is a cross section of a portion of an alternative casing cutter.

FIG. 10D is a cross section of a portion of an alternative casing cutter 1000*a* including an alternative control module 1030*a* in a retracted position. Instead of the solenoid valve, the alternative control module may include a pump 1031*a* in communication with each of the chambers 1035*a, b* via passages 1033*a, b*. The sleeve may be moved to the set position by supplying electricity to the pump and then shutting the pump off when the sleeve is in the set position as detected by the position sensor 1034.

Figure 10E:
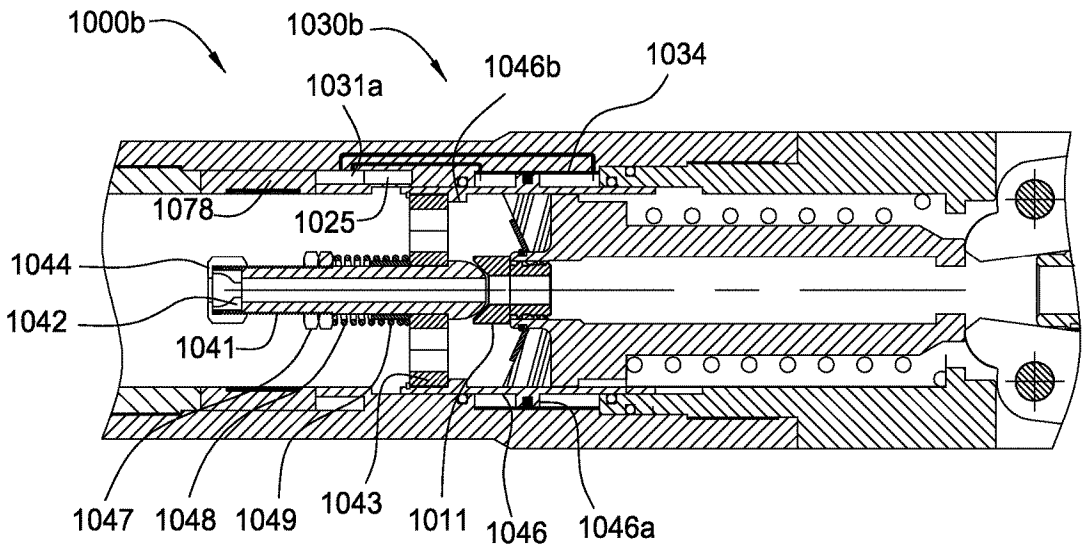
FIG. 10E is a cross section of a portion of an alternative casing cutter.

FIG. 10E is a cross section of a portion of an alternative casing cutter 1000*b* including an alternative control module 1030*b*. The control module 1030*b* may further include a body 1041, a nozzle 1042, a flange 1043, and a sleeve 1046. The body 1041 may include a nose formed at a bottom thereof for seating against the nozzle 1011. The nozzle 1042 may be longitudinally coupled to the body 1041 via a threaded cap 1044. The flange 1043 may be biased toward a shoulder formed in an outer surface of the body 1041 a spring 1048. The spring 1048 may be disposed between the body 1041 and one or more threaded nuts 1047 engaging a threaded outer surface of the body. The flange 1043 may be longitudinally coupled to the sleeve 1046 by abutment with a shoulder 1046*b* of the sleeve and abutment with a fastener, such as a snap ring. The flange 1043 may have one or ports formed therethrough. The body 1041 may be longitudinally movable downward toward the nozzle 1011 relative to the flange 1043 by a predetermined amount adjustable at the surface by the nuts 1047.

During normal operation in the extended position, the body nose may be maintained against the nozzle 1011. Drilling fluid may be pumped through both nozzles 1042, 1011, thereby extending the arms. As the piston 1010 moves downward toward the arms 1015, fluid pressure exerted on the body 1041 by restriction through the nozzle 1042 may push the body 1041 longitudinally toward the piston 1010, thereby maintaining engagement of the body nose and the nozzle 1011. If the arms 1015 extend past a desired cutting diameter, the nuts 1047 may abut the stop 1049, thereby preventing the body nose from following the nozzle 1011. Separation of the blade nose from the nozzle 1011 may allow fluid flow to bypass the nozzle 1042 via the flange ports, thereby creating a pressure differential detectable at the surface. To initialize or change the setting of the sleeve 1046, an instruction signal may be sent to the telemetry sub 400 and relayed to the controller 1025. The controller 1025 may move the sleeve 1046 to the setting using the pump 1031*a*, thereby also moving the body 1041.

Figure 10F:
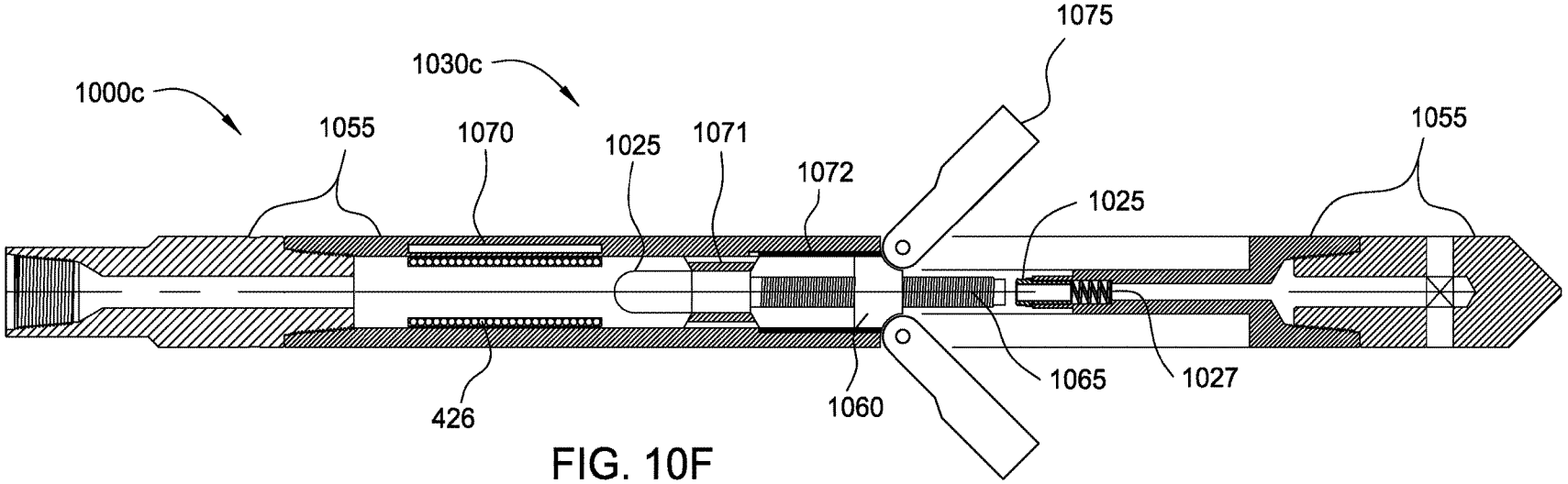
FIG. 10F is a cross section of an alternative casing cutter in an extended position.

FIG. 10F is a cross section of an alternative casing cutter 1000*c* in an extended position. The casing cutter 1000*c* may include a housing 1055, a plurality of arms 1075, a follower 1022, a follower spring 1027, and a control module 1030*c*. The housing 1055 may be tubular and may have a threaded coupling formed at a longitudinal end thereof for connection to a workstring (not shown) deployed in a wellbore for an abandonment operation. The workstring may be drill pipe or coiled tubing. To facilitate manufacture and assembly, the housing 1055 may include a plurality of longitudinal sections, each section longitudinally and rotationally coupled, such as by threaded connections, and sealed (above the arms 1075), such as by O-rings. Although shown schematically, the arms 1075 may be similar to the arms 1015 and may be returned to the retracted position by the follower 1022 and the follower spring 1027.

The control module 1030*c* may include the electronics package 1025, a cam 1060, a shaft 1065, a battery 1070, an electric motor 1071, a position sensor 1072, and an antenna 1078. The shaft 1065 may be longitudinally and rotationally coupled to the motor 1071. The shaft 1065 may include a threaded outer surface. The cam 1060 may be disposed along the shaft 1065 and include a threaded inner surface (not shown). The cam 1060 may be moved longitudinally along the shaft by rotation of the shaft 1065 by the motor 1071. As discussed above, the controller 1025 may measure the longitudinal position of the cam 1065 and the position of the arms 1075 using the position sensor 1072. The motor 1070 may further include a lock to hold the arms in the set position. Although shown schematically, as the cam 1060 moves downward, a bottom of the cam may engage a cam surface of each arm 1075, thereby rotating the arms about the pivot to the extended position. The control module 1030*c* may further include a load cell (not shown) operable to measure a cutting force exerted on the arms 1075 and the controller 1025 may be programmed to control the blade position to maintain a constant predetermined cutting force. The control module 1030*c* may communicate with the telemetry sub 400 to send a signal to the surface when the cut is finished or if the cutting forces exceed a predetermined maximum.

In operation, when it is desired to activate the cutter 1000*c*, an instruction signal may be sent to the telemetry sub 400 and relayed to the controller 1025 via the antenna 1078, thereby conveying an arm setting command. The controller 1025 may supply electricity to the motor 1071 and monitor the position of the arms 1075 until the set position is reached. The microprocessor 1025 may shut off the motor (which may also set the lock). Drilling fluid may then be circulated through the workstring from the surface and the workstring may then be rotated, thereby cutting through a wall of a casing string to be removed from the wellbore. Once the casing string has been cut, a second instruction signal may be sent commanding retraction of the arms. Alternatively, the arms may automatically retract when the cut is finished. The controller 1025 may supply reversed polarity electricity to the motor 1070, thereby unsetting the lock and moving the cam away from the arms so that the follower 1022 may retract the arms. The casing cutter 1000*c* may be redeployed in the same trip to cut a second casing string having a different diameter by sending another instruction signal including a second arm setting.

Figure 11A:
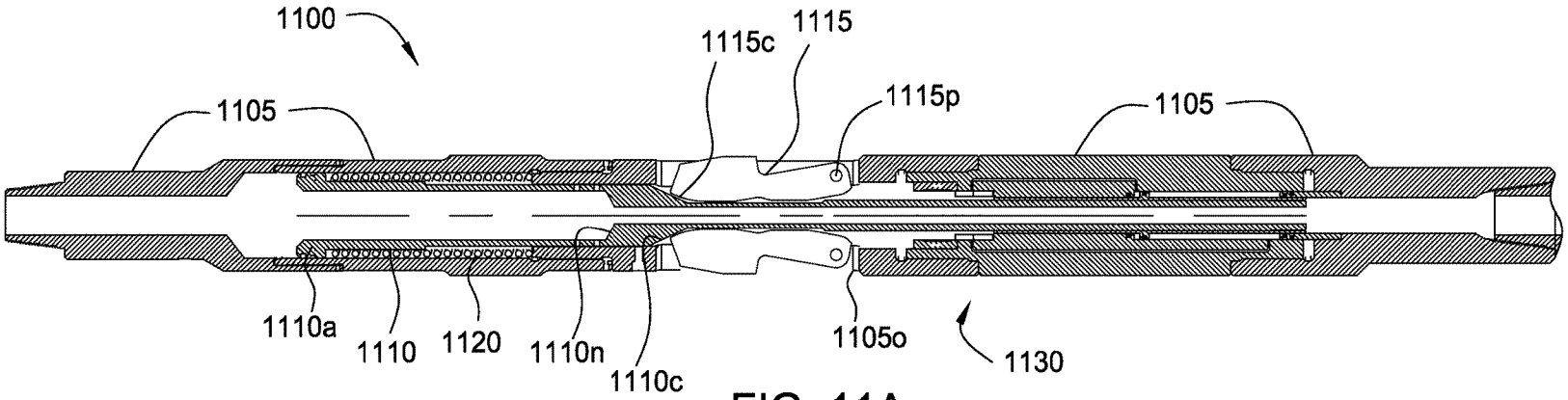
FIG. 11A is a cross section of a section mill in a retracted position, according to another embodiment of the present invention.
Figure 11B:
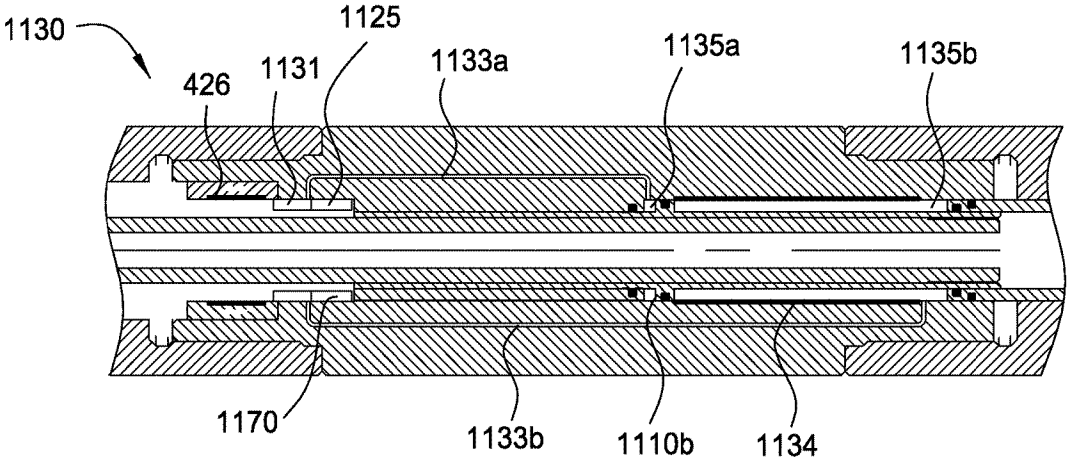
FIG. 11B is an enlargement of a portion of FIG. 11A.

FIG. 11A is a cross section of a section mill 1100 in a retracted position, according to another embodiment of the present invention. FIG. 11B is an enlargement of a portion of FIG. 11A. The section mill 1100 may include a housing 1105, a piston 1110, a plurality of arms 1115, a piston spring 1120, and a control module 1130. The control module 1130 may include an electronics package 1125, an electric pump 1131, flow passages 1133*a, b*, chambers 1135*a, b*, a second piston shoulder 1110*b*, a position sensor 1134, a battery 1170, and an antenna 1178. The electronics package 1125 may include a controller, such as microprocessor, power regulator, and transceiver.

The housing 1105 may be tubular and may have a threaded couplings formed at longitudinal ends thereof for connection to a workstring (not shown) deployed in a wellbore for a milling operation. The workstring may be drill pipe or coiled tubing. To facilitate manufacture and assembly, each of the housing 1105 and the piston 1110 may include a plurality of longitudinal sections, each section longitudinally and rotationally coupled, such as by threaded connections. Each arm 1115 may be pivoted 1115*p* to the housing 1105 for rotation relative to the housing between a retracted position and an extended position. Each arm 1115 may include a coating (not shown) of hard material, such as tungsten carbide ceramic or cermet, bonded to an outer surface and a bottom thereof. The hard material may be coated as grit. An inner surface of each arm may be cammed 1115*c*. The housing may have an opening 1105*o* formed therethrough for each arm 1115. Each arm 1115 may extend through a respective opening 1105*o* in the extended position.

The piston 1110 may be tubular, disposed in a bore of the housing 1105, and include one or more shoulders 1110*a,b*. The piston spring 1120 may be disposed between the first shoulder 1110*a* and a shoulder formed by a top of one of the housing sections, thereby longitudinally biasing the piston 1110 away from the arms 1115. The piston 1110 may have a nozzle 1110*n*. To extend the arms, drilling fluid may be pumped through the workstring to the housing bore. The drilling fluid may then continue through the nozzle 1110*n*. Flow restriction through the nozzle may cause pressure loss so that a greater pressure is exerted on the nozzle 1110*n* than on a cammed surface 1110*c* of the piston 1110*c*, thereby longitudinally moving the piston downward toward the arms and against the piston spring. As the piston 1110 moves downward, the cammed surface 1110*c* engages the cam surface 1115*c* of each arm 1115, thereby rotating the arms about the pivot 1115*p* to the extended position.

The chambers 1135*a, b* may be filled with a hydraulic fluid, such as oil. The first chamber 1135*a* may be formed radially between an inner surface of the housing 1105 and an outer surface of the piston 1110 and longitudinally between a bottom of the shoulder 1110*b* and a top of one of the housing sections. The second chamber 1135*b* may be formed radially between an inner surface of the housing and an outer surface of the sleeve and longitudinally between a top of the shoulder 1110*b* and a shoulder of the housing. The pump 1131 may be in fluid communication with each of the chambers 1135*a, b* via a respective passage 1133*a, b*.

In operation, when it is desired to activate the mill 1100, an instruction signal may be sent to the telemetry sub 400 and relayed to the controller 1125 via the antenna 1178, thereby conveying an extension command. The controller 1125 may supply electricity to the pump 1131, thereby pumping fluid from the chamber 1135*b* to the chamber 1135*a* and allowing the piston 1110 to move longitudinally downward and extending the arms 1115. As with the casing cutter, the signal may include a position setting command so that the controller may actuate the piston to the instructed set position which may be fully extended, partially extended, or substantially extended depending on the diameter of the casing/liner section to be milled. As discussed above, the controller may monitor the position of the piston shoulder

1110*b* using the position sensor 1134. Drilling fluid may then be circulated and the workstring may then be rotated and raised/lowered until a desired section of casing or liner has been removed. Once the casing/liner has been milled, the mill may be retracted by sending another instruction signal, thereby conveying retraction command. The controller may then reverse operation of the pump. Alternatively, the control module may include a motor instead of a pump in which case the piston may be a mandrel.

Figures 12A, 12B, 12C:
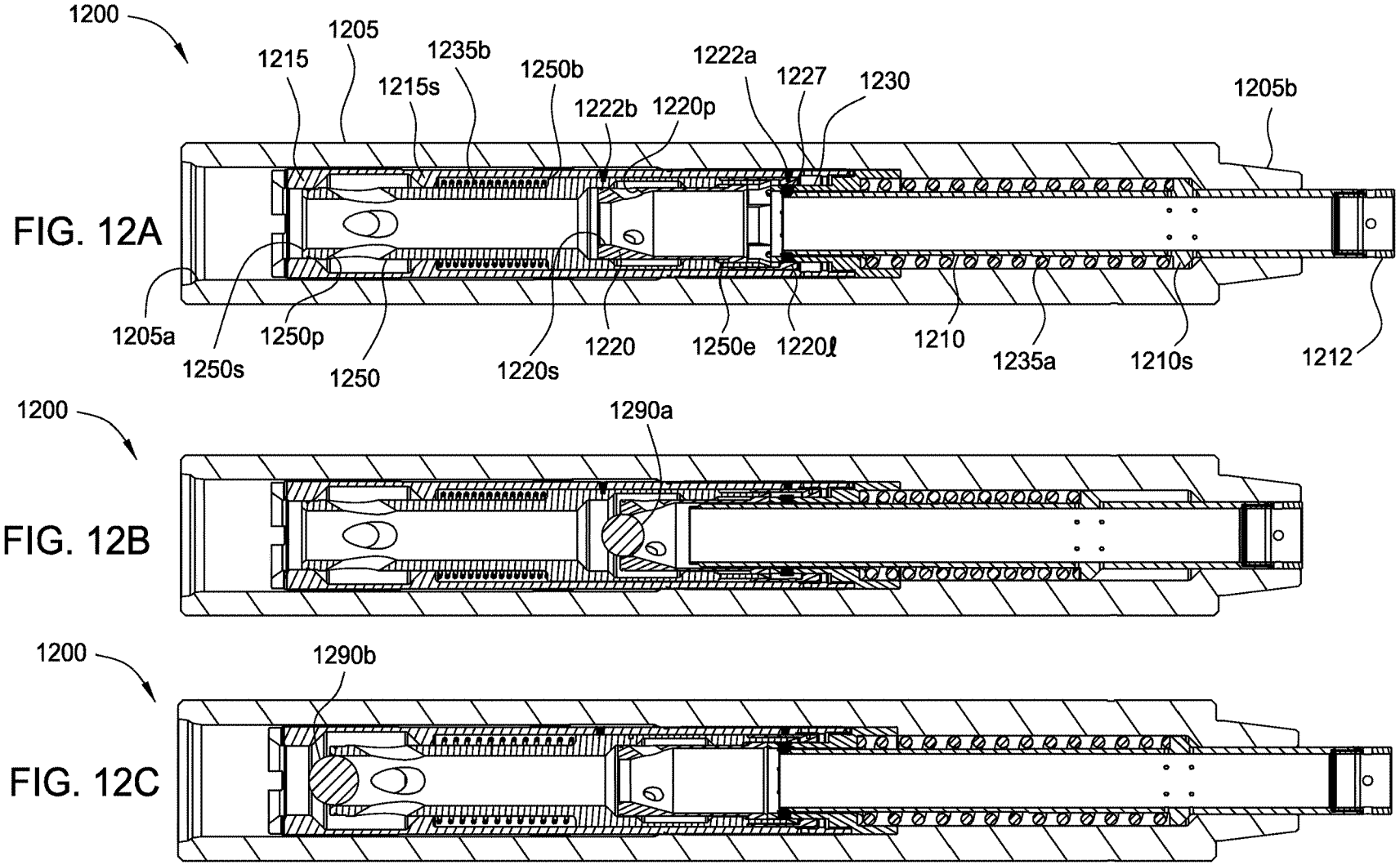
FIGS. 12A-12C are cross-sections of a mechanical control module in a first retracted, extended, and second retracted position, respectively, according to another embodiment of the present invention.

FIGS. 12A-12C are cross-sections of a mechanical control module 1200 in a first retracted, extended, and second retracted position, respectively, according to another embodiment of the present invention. The control module 1200 may include a body 1205, a control mandrel 1210, a piston housing 1215, an extension piston 1220, a lock mandrel 1230, one or more biasing members 1235*a,b*, and a retraction piston 1250. The body 1205 may be tubular and have a longitudinal bore formed therethrough. Each longitudinal end 1205*a,b* of the body 205 may be threaded for longitudinal and rotational coupling to other members, such as the underreamer 100 at 1205*b* and a drill string at 1205*a*.

The biasing members may each be springs 1235*a,b*. A return spring 1235*a* may be disposed between a shoulder 1210*s* of the control mandrel 1210 and a shoulder of the lock mandrel 1230. The return spring 1235*a* may bias a longitudinal end of the control mandrel or a control module adapter 1212 into abutment with the underreamer piston end 10*t*, thereby also biasing the underreamer piston 210 toward the retracted position. The control module adapter 1212 may be longitudinally coupled to the control mandrel 1210, such as by a threaded connection, and may allow the control module 1200 to be used with differently configured underreamers by changing the adapter 1212. The control mandrel 1210 may be longitudinally coupled to the lock mandrel 1230 by a latch or lock, such as a plurality of dogs 1227. Alternatively, the latch or lock may be a collet. The dogs 1227 may be held in place by engagement with a lip 1220*l* of the extension piston 1220 and engagement with a lip of the control mandrel 1210. The lock mandrel 1230 may be longitudinally coupled to the piston housing 1215 by a threaded connection and may abut a body shoulder and the piston housing 1215.

The piston housing 1215 may be longitudinally coupled to the body 1205 by a threaded connection. The extension piston 1220 may include recesses for receiving a slotted end 1250*e* of the retraction piston 1250. The extension piston 1220 may be longitudinally movable relative to the body 1205, the movement limited by engagement of a shoulder 1220*b* with an upper end of the lock mandrel 1230. The extension piston 1220 may be longitudinally coupled to the piston housing 1215 by one or more frangible fasteners, such as shear pin 1222*a*. The extension piston 1220 may have a seat 220*s* formed therein for receiving a dissolvable closure element, such as a ball 1290*a*, plug, or dart.

A piston spring 1235*b* may be disposed between a shoulder formed in the piston housing 1215 and a shoulder 1250*b* formed in the retraction piston 1250. The retraction piston 1250 may be longitudinally coupled to the piston housing by one or more frangible fasteners, such as shear pin 1222*b*. The retraction piston 1250 may be longitudinally movable relative to the body 1205, the movement limited by engagement of the slotted end 1250*e* with the lip 1220*l*. The extension piston 1250 may have a seat 1250*s* formed therein for receiving a closure element, such as a ball 1290*b*, plug, or dart. The seat 1250*s* may have a larger diameter than the seat 1220*s*, thereby allowing passage of the dissolvable ball 1290*a* therethrough. The ball 1290*b* may be dissolvable or non-dissolvable.

When deploying the underreamer 100 and control module 1200 in the wellbore, a drilling operation (e.g., drilling through a casing shoe) may be performed without operation of the underreamer 100. Even though force is exerted on the underreamer piston 10 by drilling fluid, the shear screws 1222*a* may prevent the underreamer piston 10 from extending the arms 50*a,b*. When it is desired to operate the underreamer 100, the ball 1290*a* is pumped or dropped from the surface and lands in the ball seat 1220*s*. Drilling fluid continues to be injected or is injected through the drill string. Due to the obstructed piston bore, fluid pressure acting on the ball 1290*a* and piston 1220 increases until the shear pin 1222*a* is fractured, thereby allowing the extension piston 1220 to move longitudinally relative to the body 1205 and disengaging the lip 1220*l* from the dogs 1227. The control mandrel lip may be inclined and force exerted on the control mandrel 1210 by the underreamer piston 10 may push the dogs 1227 radially outward into a radial gap defined between the lock mandrel 230 and the extension piston 1220, thereby freeing the control mandrel and allowing the underreamer piston 10 to extend the arms 50*a,b*. Movement of the extension piston 1220 may also open bypass ports 1220*p* formed through a wall of the extension piston 1220. The ball 1290*a* may then gradually dissolve as drilling continues.

When or if it is desired to re-lock the arms 50*a,b* in the retracted position, the second ball 1290*b* is pumped or dropped from the surface and lands in the ball seat 1250*s*. Drilling fluid continues to be injected or is injected through the drill string. Due to the obstructed piston bore, fluid pressure acting on the ball 1290*b* and piston 1250 increases until the shear pin 1222*b* is fractured, If the ball 1290*b* was dropped, the retraction piston 1250 may move longitudinally relative to the body 1205 and engage the end 1250*e* with the dogs 1227, push the dogs 1227 into engagement with the control mandrel lip, and continue until engaging the extension piston lip 1220*l*. If the ball 1290*b* was pumped, the retraction piston 1250 may move longitudinally relative to the body 1205 and engage the end 1250*e* with the dogs 1227 and stop due to interference with an outer surface of the control mandrel 1210. Injection of drilling fluid may then be halted allowing the return spring 1235*a* to push the control mandrel 1210 and underreamer piston 10 to the retracted position. The piston spring 1235*b* may then push the retraction piston 1250 to engage the dogs 1227 with the control mandrel lip. Movement of the retraction piston 1250 by the piston spring 1235*b* may continue until the end 1250*e* engages the extension piston lip 1220*l*. Movement of the retraction piston 1250 may also open bypass ports 1250*p* formed through a wall thereof.

Alternatively, instead of a dissolvable ball 1290*a*, the extension piston 1220 may be modified so that the ball seat 1220*s* is radially movable between a contracted position and an extended position. The modified ball seat 1220*s* may receive the (non-dissolvable) ball in the contracted position and move to the extended position as the extension piston 1220 moves longitudinally. To allow radial movement, the ball seat may be split into fingers biased toward the extended position. In the extended position, the ball seat may allow passage of the ball therethrough. The ball may then be caught by a receptacle (not shown) located in the underreamer adapter. Alternatively, instead of a dissolvable ball 1290*a*, the ball 1290*a* may be deformable. The ball 1290*a* may be received by the seat 1220*s* until a predetermined deformation pressure is applied. The pressure necessary to shear the pins 1222*b* may be less or substantially less than the deformation pressure. Once the deformation pressure exerted on the deformable ball is exceeded, the ball may elastically or plastically deform and pass through the seat 1220*s* and be received by the receptacle, discussed above.

Figure 13A:
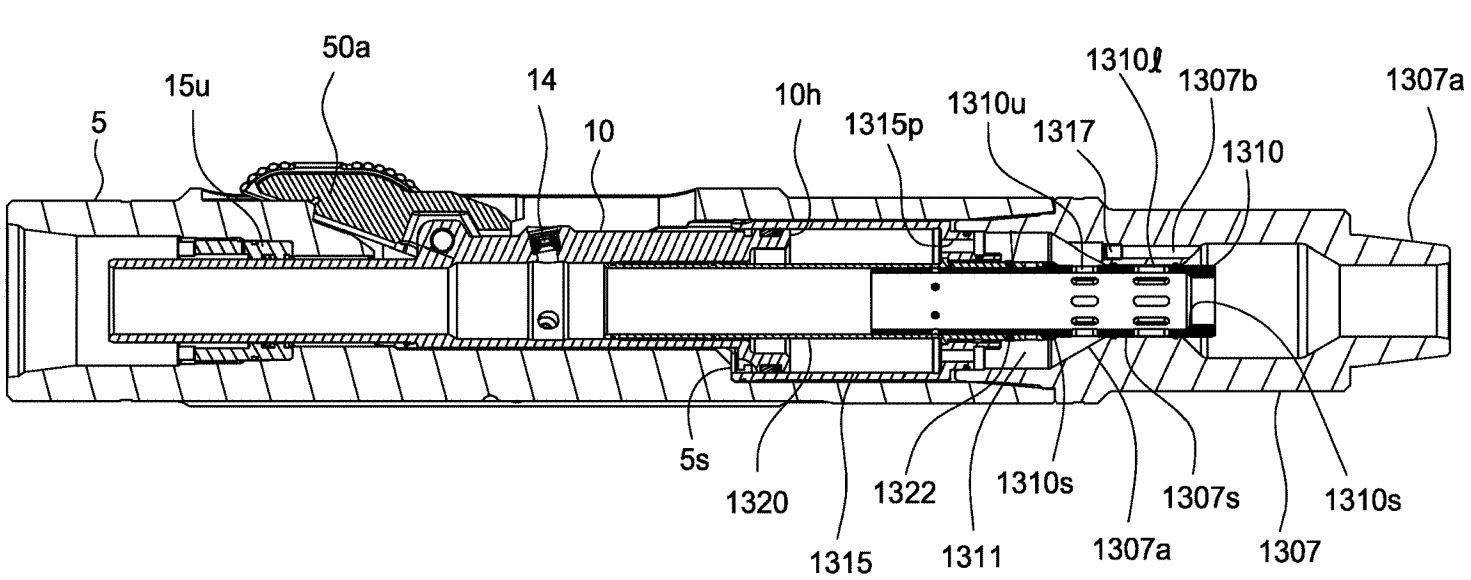
FIGS. 13A and 13B are cross-sections of an underreamer in an extended and second retracted position, respectively, according to another embodiment of the present invention.
Figure 13B:
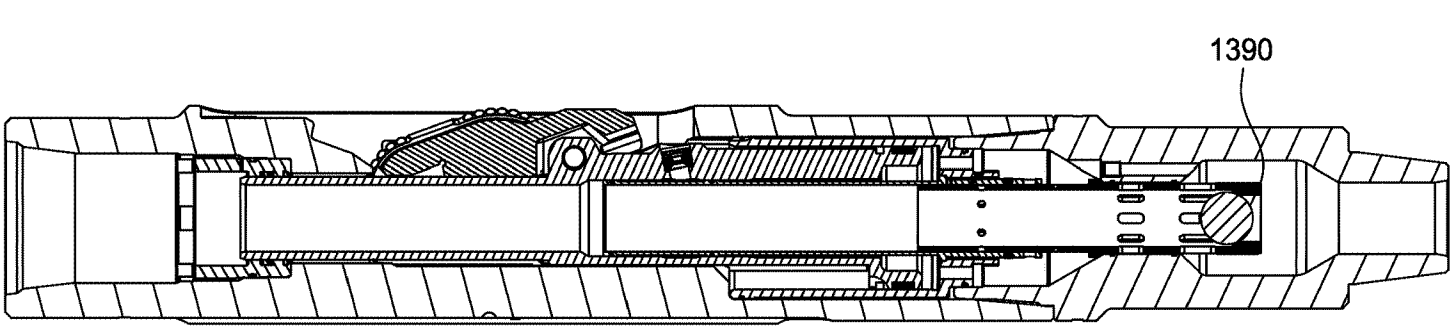

FIGS. 13A and 13B are cross-sections of an underreamer 1300 in an extended and second retracted position, respectively, according to another embodiment of the present invention. The underreamer 1300 may include a body 5, an adapter 1307, an extension piston 10, a retraction piston 1310, one or more seal sleeves 15*u*, 1315, a mandrel 1320, a retraction piston and one or more arms 50*a,b* (see FIG. 1C for 50*b*). Relative to the underreamer 100, reference numerals for unchanged parts have been kept and the discussion thereof is not repeated.

An end 1307*a* of the adapter 1307 distal from the body may be threaded for longitudinal and rotational coupling to another member of a bottomhole assembly (BHA). The mandrel 1320 may be tubular, have a longitudinal bore formed therethrough, and be longitudinally coupled to the lower seal sleeve 1315 by a threaded connection. The lower seal sleeve 1315 may be longitudinally coupled to the body 5 by being disposed between the shoulder 5*s* and a top of the adapter 1307. The lower seal sleeve 1315 may have one or more longitudinal ports 1315*p* formed through a cap thereof. The ports 1315*p* may provide fluid communication between the piston surface 10*h* and a control chamber 1311 formed between the adapter 1307 and the retraction piston 1310. The retraction piston 1310 may include one or more upper ports 1310*u* and one or more lower ports 1310*l* formed through a wall thereof. The upper ports 1310*u* may provide fluid communication between a bore of the retraction piston and the control chamber 1311.

The retraction piston 1310 may be received by a seat 1307*s* formed in the adapter 1307. A bypass 1307*b* may be formed through the seat 1307*s* and a check valve 1317 may be disposed in the bypass and oriented to allow fluid flow from a bore of the adapter to the control chamber but to prevent flow of fluid from the control chamber to the adapter bore. The retraction piston may be longitudinally coupled to the mandrel 1320 by one or more frangible fasteners, such as shear pins 1322. The lower ports 1310*l* may be closed. The retraction piston 1310 may have a seat 1310*s* formed therein receiving a closure element, such as a ball 1390, plug, or dart. The ball 1390 may be dissolvable or non-dissolvable. The retraction piston 1310 may have a shoulder 1310*s* engageable with a shoulder 1307*a* formed in the adapter 1307.

The underreamer 1300 may be deployed with the control module 200 in a similar fashion as the underreamer 100 with the exception that the underreamer 1300 may be re-locked in the retracted position. The ball 290 may be removed as discussed above for removing the ball 1290*a* (e.g., by deforming, dissolving, or modifying the ball seat to be extendable). When or if it is desired to re-lock the arms 50*a,b* in the retracted position, the ball 1390 is pumped or dropped from the surface and lands in the ball seat 1310*s*. Drilling fluid continues to be injected or is injected through the drill string. Due to the obstructed piston bore, fluid pressure acting on the ball 1390 and retraction piston 1310 increases until the shear pins 1322 are fractured. The retraction piston 1310 may move longitudinally relative to the body 1305 until the shoulder 1310*s* engages the shoulder 1307*a*, thereby opening lower ports 1310*l* and closing upper ports 1310*u*. Closing of the upper ports 1310*u* may isolate the control chamber 1311 except for the check valve 1317 allowing retraction of the extension piston 10 via bypass 1307*b*. The lower ports 1310 provide fluid communication between around the closed ball seat. The ball 1390 may or may not gradually dissolve to reopen the seat 1310*s*. Injection of drilling fluid may then be halted, thereby allowing the control module spring to retract the arms 50*a,b*. Once the arms are retracted, isolation of the piston surface 10*h* prevents further extension of the arms 50*a,b* when drilling fluid is injected through the underreamer 1300.

Alternatively, a similar effect may be achieved by adding a circulation sub (not shown) to a BHA including the underreamer 100 and the control module 200. The circulation sub may include a body having a bore therethrough and one or more ports formed through a wall thereof. A piston may be disposed in the body and seal the port in a closed position. The piston may have a seat for receiving a closure member, such as a ball. The piston may be longitudinally coupled to the body by one or more frangible fasteners, such as shear pins. The piston may be longitudinally movable relative to the body to an open position where the ports are in fluid communication with the body bore. In operation, after the underreaming operation is complete, the ball may be pumped or dropped down to the seat. The circulation seat may be larger than the control module seat to allow passage of the ball 290. The circulation ball may land in the circulation seat and pressure may increase or be increased to fracture the shear pins and move the piston to the open position. The ball and piston may seal or at least substantially obstruct the body bore below the ports, thereby preventing fluid pressure from operating the underreamer piston and allowing the cleaning operation, discussed above to be performed without extending the underreamer arms.

Figure 14A:
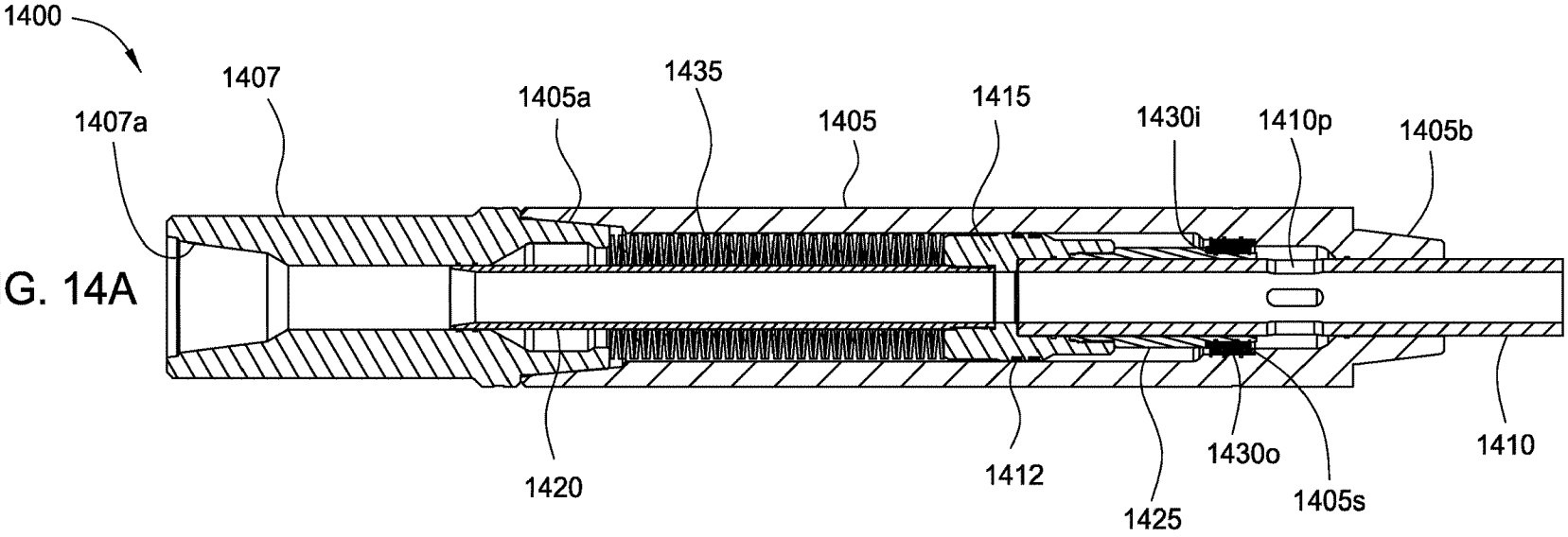
FIGS. 14A and 14B are cross-sections of a hydraulic control module in a retracted and extended position, respectively, according to another embodiment of the present invention.
Figure 14B:
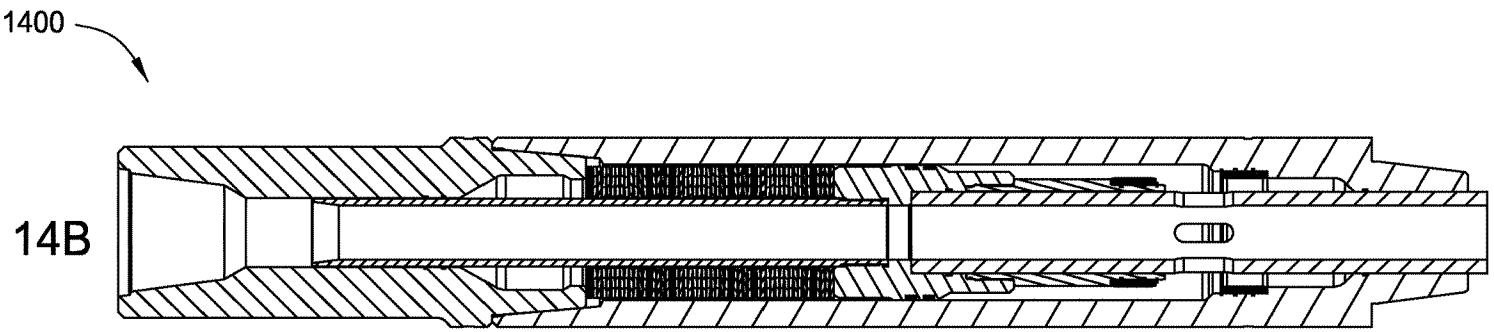

FIGS. 14A and 14B are cross-sections of a hydraulic control module 1400 in a retracted and extended position, respectively, according to another embodiment of the present invention. The control module 1400 may include a body 1405, an adapter 1407, a control mandrel 1410, a piston 1415, a piston mandrel 1420, a valve mandrel 1425, a valve head 1430*i*, a valve seat 14300, and a biasing member 1435. The body 1405 may be tubular and have a longitudinal bore formed therethrough. Each longitudinal end 1405*a,b* of the body 1405 may be threaded for longitudinal and rotational coupling to other members, such as the underreamer 100 at 1405*b* and the adapter at 1405*a*. The adapter 1407 may be tubular and have a longitudinal bore formed therethrough. Each longitudinal end 1407*a* of the adapter 1407 may be threaded for longitudinal and rotational coupling to other members, such as the drill string at 1407*a*.

The biasing member may be a spring, such as a Belleville spring 1435, and may be disposed between a bottom of the adapter 1407 and a top of the piston 1415. The spring 1435 may bias a longitudinal end of the control mandrel 1410 or a control module adapter (not shown) into abutment with the underreamer piston end, thereby also biasing the underreamer piston toward the retracted position. Advantageously, a preload of the Belleville spring 1435 may be easily adjusted for various underreamer configurations. The control mandrel 1410 may be longitudinally coupled to the piston 1415, such as with a threaded connection. The piston mandrel 1420 may be longitudinally coupled to the piston 1415, such as with a threaded connection. A vent (not shown) may be formed through a wall of the body 1405 and provide fluid communication between a spring chamber formed radially between the spring mandrel and the body and an exterior of the control module 1400.

The valve head 1430*i* and seat 1430*o* may each be rings made from an erosion resistant material, such as a metal, alloy, ceramic, or cermet. The valve head 1430*i* may be longitudinally coupled to the valve mandrel 1425, such as by being disposed between a shoulder formed in the valve mandrel 1425 and a fastener (not easily seen due to scale). The valve mandrel 1425 may be longitudinally coupled to the piston 1415, such as with a threaded connection. The valve seat 1430*o* may be longitudinally coupled to the body 1405, such as by being disposed between a shoulder 1405*s* formed in the body 14205 and a fastener (not easily seen due to scale). One or more seals, such as o-rings 1412, may be disposed between the piston 1415 and the body 1405 and may isolate the spring chamber from a piston chamber formed radially between the piston 1415/valve mandrel and the body 1405. Various other seals, such as o-rings may be disposed throughout the control module 1400.

The valve 1430*i,o* may be operable between an open and closed position. In the closed position, the valve 1430*i,o* may at least substantially isolate the piston chamber from a valve chamber formed radially between the control mandrel 1410 and the body 1405. One or more ports 1410*p* formed through a wall of the control mandrel 1410 may provide fluid communication between the valve chamber and a bore of the control mandrel. A predetermined radial clearance (not easily seen due to scale) may be formed between the valve head 1430*i* and seat 1430*o* to at least restrict, substantially restrict, or severely restrict fluid flow between the valve chamber and the piston chamber. The predetermined radial clearance may be less than or equal to 0.005 inch, 0.004 inch, 0.003 inch, or 0.002 inch. Alternatively, the valve head and seat may each be tapered so that the head contacts the seat in the closed position, thereby forming a seal.

When deploying the underreamer 100 and control module 1400 in the wellbore, a drilling operation (e.g., drilling through a casing shoe) may be performed without extension of the underreamer 100. Even though force is exerted on the underreamer piston 10 by drilling fluid, the spring 1435 preload may prevent the underreamer piston 10 from extending the arms 50*a,b* at least for a predetermined duration of time sufficient to drill through the casing shoe. When it is desired to operate the underreamer 100, an injection rate of the drilling fluid is substantially increased from the normal drilling flow rate. Fluid pressure acting on the underreamer piston 10 (and an end of the valve mandrel and an end of the valve head) increases until the spring preload is overcome, thereby moving the piston 1415 and mandrels 1420, 1425 longitudinally relative to the body, opening the valve 1430*i, o*, and compressing the spring 1435. With the valve open, drilling fluid pressure may act on the control module piston 1415 and the underreamer piston 10 so that the drilling fluid rate may be reduced to normal while retaining the valve in the open position and the underreamer in the extended position. Further, injection of the drilling fluid may be halted and the valve may be re-closed to allow a further operation to be performed while injecting drilling fluid with the underreamer retracted, such as a cleanout operation, discussed above.

Alternatively, any of the control modules 200, 300, 600, 630, 650, 1030, 1030*a-c*, 1130, 1200, 1400 may be used with any of the underreamer 100, casing cutter 1000, or section mill 1100. Alternatively, the section mill may be used in an underreaming operation or vice versa. Alternatively, any of the sensors or electronics of the telemetry sub 400 may be incorporated into any of the control modules 300, 600, 630, 650, 1030, 1030*a-c*, 1130 and the telemetry sub 400 may be omitted.

Additionally, as with the underreamer, two section mills may be connected. The primary section mill may be extended to mill a section of casing/liner. Once the arms of the primary mill become worn, the backup mill may be extended by sending an instruction signal, thereby commanding retraction of the primary mill and extension of the backup mill. The milling operation may then continue without having to remove the primary mill to the surface for repair. Alternatively, two casing cutters 1000 may be deployed in a similar fashion. Alternatively, also as with the underreamer, a stabilizer or adjustable stabilizer may be used with the casing cutter or section mill or with two casing cutters or section mills.

In another alternative (not shown), any of the electric control modules 300, 600, 630, 650, 1030, 1030*a-c*, 1130 may include an override connection in the event that the telemetry sub 400 and/or controllers of the control modules fail. An actuator may then be deployed from the surface to the control module through the drill string using wireline or slickline. The actuator may include a mating coupling. The actuator may further include a battery and controller if deployed using slickline. The override connection may be a contact or hard-wire connection, such as a wet-connection, or a wireless connection, such as an inductive coupling. The override connection may be in direct communication with the control module actuator, e.g., the solenoid valve, so that transfer of electricity via the override connection will operate the control module actuator.

In another alternative (not shown), any of the electric control modules 300, 600, 630, 650, 1030, 1030*a-c*, 1130 may be deployed without the electronics package and without the telemetry sub and include the override connection, discussed above. The wireline or slickline actuator may then be deployed each time it is desired to operate the control module.

Additionally, the telemetry sub 400 or any of the sensors or electronics thereof may be used with the motor actuator, the jar actuator, the vibrating jar actuator, the overshot actuator, or the disconnect actuator disclosed and illustrated in the '077 application.

While the foregoing is directed to embodiments of the present invention, other and further embodiments of the invention may be devised without departing from the basic scope thereof, and the scope thereof is determined by the claims that follow.

The invention claimed is:

1. A tool for use in a wellbore, comprising:

a tubular body having a central bore therethrough, a piston:

disposed in the central bore, and operable to activate the tool;

a lock operable to retain the piston in a deactivated position;

a pump disposed in the tubular body and operable to move the piston;

an antenna in communication with the central bore for receiving a first instruction signal from a radio frequency identification (RFID) tag pumped through the central bore;

a pressure sensor in communication with the central bore for receiving a second instruction signal from pressure pulses transmitted through the central bore; and an electronics package in communication with the antenna and the pressure sensor and having a controller operable to release the lock and operate the pump in response to receiving one of the instruction signals.

2. The tool of claim 1, further comprising a spring biasing the piston toward the deactivated position.

3. The tool of claim 2, wherein the lock comprises:
a hydraulic chamber; and
a valve in fluid communication with the hydraulic chamber and operable by the controller, and
a position piston disposed in the hydraulic chamber and biased into engagement with the piston by the spring.

4. The tool of claim 1, wherein:
the body further has a plurality of openings through a wall thereof and first actuation profiles formed in surfaces thereof adjacent the respective openings;
the tool further comprises a plurality of arms:
having second actuation profiles corresponding to the respective first actuation profiles,
disposed in the respective openings in a retracted position, and
movable to an extended position where an outer surface of each arm extends outward past an outer surface of the tubular body;
the piston is an arm piston operable to move the arms from the retracted position to the extended position in response to fluid pressure in the piston bore exceeding fluid pressure in the openings and by moving longitudinally relative to the body, thereby moving the arms along the respective first actuation profiles.

5. The tool of claim 4, wherein:
each arm is pivotally connected to the arm piston and rotationally coupled to the body,
each arm is rotatable about the respective pivotal connection and relative to the body during extension from the retracted position to the extended position to accommodate movement of the respective arm along the respective first actuation profile, and
the respective actuation profiles are disengaged in the retracted position.

6. The tool of claim 5, wherein:
each actuation profile has a longitudinally inclined portion, a longitudinally flat portion, and a shoulder formed between the inclined and flat portions, and
the respective shoulders are engaged in the extended position.

7. The tool of claim 6, wherein each shoulder is radially inclined to create a radially inward component of a normal reaction force between the respective arm and the respective body.

8. The tool of claim 4, wherein the tool is an underreamer and further comprises cutters disposed along outer surfaces of the arms.

9. The tool of claim 1, the piston having a bore therethrough.

10. The tool of claim 1, wherein the pump is disposed in the central bore.

11. A method of drilling a wellbore using the underreamer of claim 8, comprising:
running a drilling assembly into the wellbore through a casing string, the drilling assembly comprising a tubular string, the underreamer, and a drill bit;
injecting drilling fluid through the tubular string and rotating the drill bit, wherein the underreamer remains locked in the retracted position;
while injecting the drilling fluid, extending the arms by sending one of the instruction signals to the underreamer from surface; and
reaming the wellbore using the extended underreamer.

12. The method of claim 11, wherein the underreamer remains locked in the retracted position while drilling through a shoe of the casing string.

13. The method of claim 11, wherein:
the wellbore is drilled and reamed with the extended underreamer and the drill bit, and
the method further comprises:
sending another one of the instruction signals and halting injection of the drilling fluid, thereby retracting and relocking the underreamer; and
resuming injection of the drilling fluid while the underreamer is retracted and relocked.

14. An underreamer for use in a wellbore, comprising
a tubular body;
a plurality of arms movably attached to the tubular body;
cutters disposed along outer surfaces of the arms;
an arm piston operable to move the arms relative to the tubular body;
an annular control module, comprising:
a central bore therethrough;
a lock disposed at a periphery of the central bore and operable to retain the arm piston in the retracted position;
a pump disposed in the tubular body and operable to move the arm piston; and
an electronics package disposed at the periphery of the central bore, in communication with a pressure sensor and the pump, and having a controller operable to release the lock in response to receiving an instruction signal from the pressure sensor; and
the pressure sensor in communication with the central bore for receiving the instruction signal from pressure pulses transmitted through the central bore.

15. The tool of claim 14, further comprising a spring biasing the piston toward an deactivated position.

16. The tool of claim 15, wherein the lock comprises:
a hydraulic chamber; and
a valve in fluid communication with the hydraulic chamber and operable by the controller, and
a position piston disposed in the hydraulic chamber and biased into engagement with the piston by the spring.

17. The tool of claim 14, wherein:
each arm is pivotally connected to the arm piston and rotationally coupled to the body,
each arm is rotatable about the respective pivotal connection and relative to the tubular body during extension from a retracted position to an extended position to accommodate movement of the respective arm along a respective actuation profile, and
the respective actuation profiles are disengaged in the retracted position.

18. The tool of claim 17, wherein:
each actuation profile has a longitudinally inclined portion, a longitudinally flat portion, and a shoulder formed between the inclined and flat portions, and
the respective shoulders are engaged in the extended position.

19. The underreamer of claim 14, wherein the controller is operable to activate the pump to move the arm piston in response to receiving an instruction signal from the pressure sensor.

20. A tool for use in a wellbore, comprising:
a tubular body having a bore extending from a first end to a second end;
a piston disposed in the bore;
a pump disposed in the tubular body and operable to move the piston;

a lock operable to retain the piston in a retracted position; and a controller operable to receive an instruction signal and operable to release the lock and operate the pump in response to receiving the instruction signal.

* * * * *